US011220109B2

(12) United States Patent
Hanano

(10) Patent No.: US 11,220,109 B2
(45) Date of Patent: Jan. 11, 2022

(54) RECORDING HEAD MAINTENANCE DEVICE AND INKJET RECORDING APPARATUS THEREWITH

(71) Applicant: KYOCERA Document Solutions Inc., Osaka (JP)

(72) Inventor: Susumu Hanano, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 18 days.

(21) Appl. No.: 16/788,797

(22) Filed: Feb. 12, 2020

(65) Prior Publication Data

US 2020/0282727 A1 Sep. 10, 2020

(30) Foreign Application Priority Data

Mar. 8, 2019 (JP) ..... JP2019-042992

(51) Int. Cl.
*B41J 2/165* (2006.01)

(52) U.S. Cl.
CPC ..... *B41J 2/16538* (2013.01)

(58) Field of Classification Search
None
See application file for complete search history.

(56) References Cited

U.S. PATENT DOCUMENTS 7,427,122 B2 * 9/2008 Nakashima ..... B41J 2/16505 347/29
8,376,509 B2 * 2/2013 Wong ..... B41J 2/16547 347/33
2008/0286021 A1 11/2008 Asami ..... 399/351
2015/0116422 A1 * 4/2015 Tanda ..... B41J 2/16538 347/29

FOREIGN PATENT DOCUMENTS

JP 2008-284718 A 11/2008

* cited by examiner

*Primary Examiner* — Alejandro Valencia
(74) *Attorney, Agent, or Firm* — Stein IP, LLC

(57) ABSTRACT

A maintenance device has a maintenance unit. The maintenance unit has a blade unit to which a plurality of wiping blades are fixed, a wiper carriage to which the blade unit is attached, and a support frame that supports the wiper carriage. The wiper carriage has a stationary portion with a sliding roller, a movable portion with a positioning roller, and an elastic member. The elastic member elastically supports the movable portion relative to the stationary portion, and elastically contracts, when the maintenance unit is pressed against a plurality of recording heads by a unit ascent-descent mechanism with an excessive pressing force stronger than a predetermined pressing force, by receiving the reaction force of the excessive pressing force.

3 Claims, 18 Drawing Sheets

RECORDING HEAD MAINTENANCE DEVICE AND INKJET RECORDING APPARATUS THEREWITH

INCORPORATION BY REFERENCE

This application is based on and claims the benefit of Japanese Patent Application No. 2019-042992 filed on Mar. 8, 2019, the contents of which are hereby incorporated by reference.

BACKGROUND

The present disclosure relates to a recording head maintenance device that performs maintenance in which it wipes an ink ejection surface of a recording head in an inkjet recording apparatus, and relates also to an inkjet recording apparatus provided with such a maintenance device.

In an inkjet recording apparatus that records an image by ejecting ink onto a recording medium from a recording head, if foreign matter such as powdery dust and paper powder or ink with increased viscosity sticks to a nozzle plate that forms nozzle apertures of the recording head, it adversely affects ink ejection performance and degrades printing quality. To cope with that, there has been conventionally proposed an inkjet recording apparatus furnished with a mechanical cleaning function whereby the ink ejection surface of the nozzle plate is rubbed with a wiping blade formed of an elastic material to remove powdery dust and paper powder stuck to the nozzle plate.

In the above inkjet recording apparatus, when the nozzle plate of the recording head is cleaned, the recording head is first raised and then a maintenance unit including a wiping blade is moved horizontally to right under the recording head; thereafter the recording head is lowered so that the nozzle plate makes contact with the wiping blade of the maintenance unit. In this state, it is possible, by moving the wiping blade in the wiping direction, to wipe the ink ejection surface of the recording head.

Here, when the ink ejection surface of the recording head makes contact with the wiping blade, due to dimensional errors in the components of the recording head and the maintenance unit and errors (variations) occurring during assembly, the wiping blade may be pressed, in relative terms, against the ink ejection surface with an excessive pressing force. This makes it difficult for the motor leading to the motor being overloaded.

In the above inkjet recording apparatus, springs are arranged right under individual wiping blades provided respectively for a plurality of recording heads so that each wiping blade is held inclinably, and the individual wiping blades are respectively brought into contact with the nozzle plates (ink ejection surfaces) of the plurality of recording heads.

SUMMARY

According to one aspect of the present disclosure, a recording head maintenance device includes: a maintenance unit having a plurality of wiping blades that wipe the ink ejection surfaces of a plurality of recording heads that eject ink onto a recording medium; a maintenance carriage that supports the maintenance unit; and a unit movement mechanism that moves the maintenance carriage reciprocally between a first position where the maintenance carriage faces, across an interval, the ink ejection surfaces of the plurality of recording heads and a second position where the maintenance carriage is retracted from the first position in the horizontal direction. The maintenance carriage has a unit ascent-descent mechanism that raises and lowers the maintenance unit between the first position and a third position where the maintenance unit is in contact with the plurality of recording heads. The maintenance unit has: a blade unit to which the plurality of wiping blades are fixed; a wiper carriage to which the blade unit is attached; and a support frame that supports the wiper carriage. The support frame has a wiper movement mechanism that moves the wiper carriage in the direction in which the plurality of wiping blades wipe the ink ejection surfaces of the plurality of recording heads. The wiper carriage has: a stationary portion that has a sliding roller sliding on the support frame as the plurality of wiping blades are moved by the wiper movement mechanism; a movable portion that supports the blade unit and that has a positioning roller restricting, as the maintenance unit is moved from the first position toward the third position, the position of the plurality of wiping blades in their receding direction relative to the ink ejection surfaces of the plurality of recording heads by making contact with a head housing supporting the plurality of recording heads; and an elastic member that elastically supports the movable portion relative to the stationary portion and that elastically contracts, when the maintenance unit is pressed against the plurality of recording heads by the unit ascent-descent mechanism with an excessive pressing force stronger than a predetermined pressing force, by receiving the reaction force of the excessive pressing force.

This and other objects of the present disclosure, and the specific benefits obtained according to the present disclosure, will become apparent from the description of embodiments which follows.

DETAILED DESCRIPTION

In the conventional inkjet recording apparatus structured as described above, the springs are arranged right under the individual wiping blades. This makes it difficult for each wiping blade to keep a stable position. This may cause uneven wiping of different ink ejection surfaces by different wiping blades.

An object of the present disclosure is to provide, as a recording head maintenance device configured to perform maintenance of a recording head by moving a maintenance unit to a position facing the ink ejection surface of a recording head, a recording head maintenance device that can, while pressing a plurality of wiping blades respectively against the ink ejection surfaces of a plurality of recording heads with an adequate pressing force, wipe the ink ejection surfaces and that can, by holding the plurality of wiping blades stably, suppress uneven wiping of the ink ejection surfaces among the plurality of wiping blades. Another object of the present disclosure is to provide an inkjet recording apparatus provided with such a recording head maintenance device.

Structure of Inkjet Recording Apparatus

Figure 1:
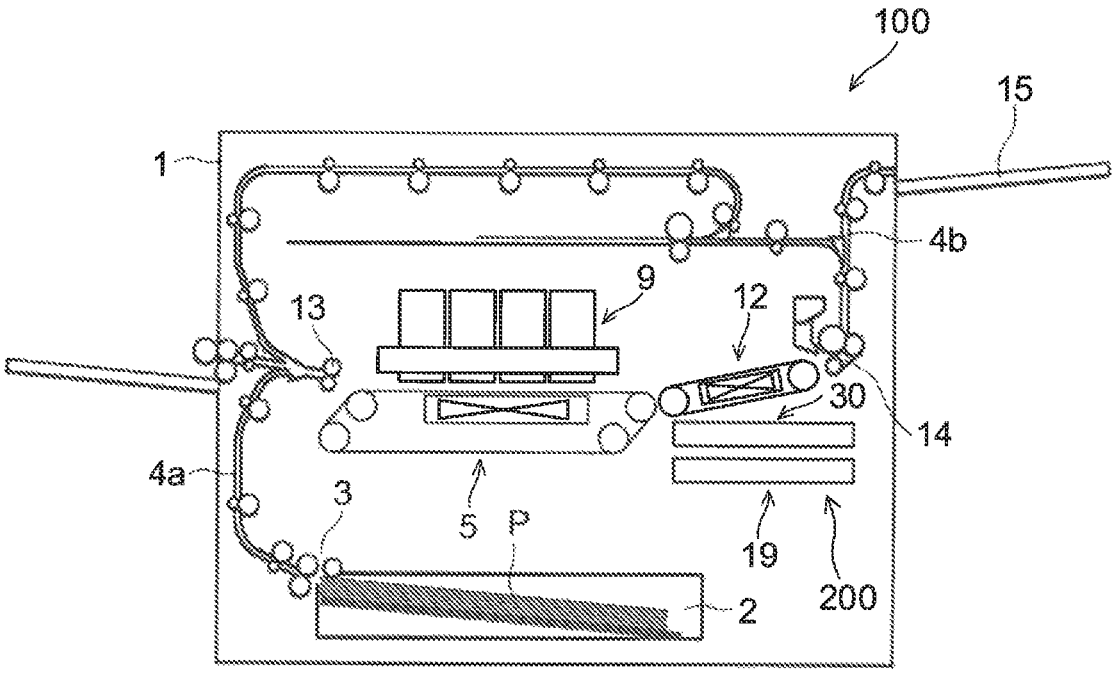
FIG. 1 is a sectional view showing an outline of a structure of a printer as an inkjet recording apparatus provided with a maintenance device according to one embodiment of the present disclosure.

Hereinafter, with reference to the accompanying drawings, a printer 100 will be described as an example of an inkjet recording apparatus incorporating a maintenance device 200 according to the present disclosure. As shown in FIG. 1, the printer 100 has a sheet feed cassette 2 as a sheet storage portion arranged in a lower part inside a printer body 1. In the sheet feed cassette 2, sheets P as an example of a recording medium are stored. On the downstream side of the sheet feed cassette 2 with respect to the sheet conveying direction, that is, at the upper left of the sheet feed cassette 2 in FIG. 1, a sheet feed device 3 is arranged. The sheet feed device 3 feeds out the sheets P, while separating one from another, one by one to the upper left of the sheet feed cassette 2.

Inside the printer 100, a first sheet conveying passage **4*a* is provided. The first sheet conveying passage 4*a* is located to the upper left of the sheet feed cassette 2. A sheet P fed out of the sheet feed cassette 2 is conveyed by the first sheet conveying passage 4*a* vertically up along a side face of the printer body 1**.

At the downstream-side end of the first sheet conveying passage **4*a* with respect to the sheet conveying direction, a pair of registration rollers 13 is arranged. On the downstream side of the pair of registration rollers 13 with respect to the sheet conveying direction, close to it, a first belt conveying portion 5 (recording medium conveying portion) and a recording portion 9 are arranged. The sheet P fed out of the sheet feed cassette 2 passes through the first sheet conveying passage 4*a* and reaches the pair of registration rollers 13. The pair of registration rollers 13 keeps the sheet P at a halt for a while to correct skew feeding and, with timing coordinated with the ink ejection operation performed by the recording portion 9, restarts conveying the sheet P toward the first belt conveying portion 5**.

On the downstream side (in FIG. 1, on the right side) of the first belt conveying portion 5 with respect to the sheet conveying direction, a second belt conveying portion 12 is arranged. The sheet P having an ink image recorded on it in the recording portion 9 is fed to the second belt conveying portion 12, and while the sheet P is passing through the second belt conveying portion 12, the ink ejected on the surface of the sheet P is dried.

On the downstream side of the second belt conveying portion 12 with respect to the sheet conveying direction, near the right side face of the printer body 1, a decurler 14 is provided. The sheet P having the ink dried in the second belt conveying portion 12 is fed to the decurler 14, where a curl developed in the sheet P is decurled by a plurality of rollers arrayed in the sheet width direction.

On the downstream side of (in FIG. 1, over) the decurler 14 with respect to the sheet conveying direction, a second sheet conveying passage **4*b* is provided. The sheet P having passed through the decurler 14 is, unless duplex printing is performed, discharged from the second sheet conveying passage 4*b* via a pair of discharge rollers onto a sheet discharge tray 15 provided outside the right side face of the printer 100**.

Figure 4:
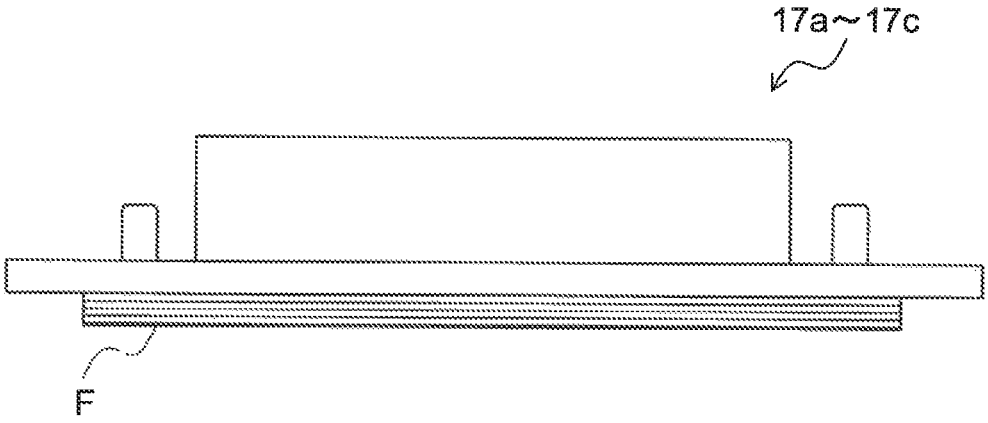
FIG. 4 is a sectional view of recording heads provided in the recording portion.

Under the second belt conveying portion 12, a maintenance unit 19 and a cap unit 30 are arranged. The maintenance unit 19, when performing purging (described later), moves horizontally to under the recording portion 9, wipes off the ink exuded out of ejection nozzles 18 (see FIG. 2) in recording heads 17*a* to 17*c* (described later), and collects the ink wiped off. The cap unit 30, when capping the ink ejection surfaces F (see FIG. 4) of the recording heads 17*a* to 17*c*, moves horizontally to under the recording portion 9, and then moves up to be attached to the bottom faces of the recording heads 17*a* to 17*c*.

Figure 2:
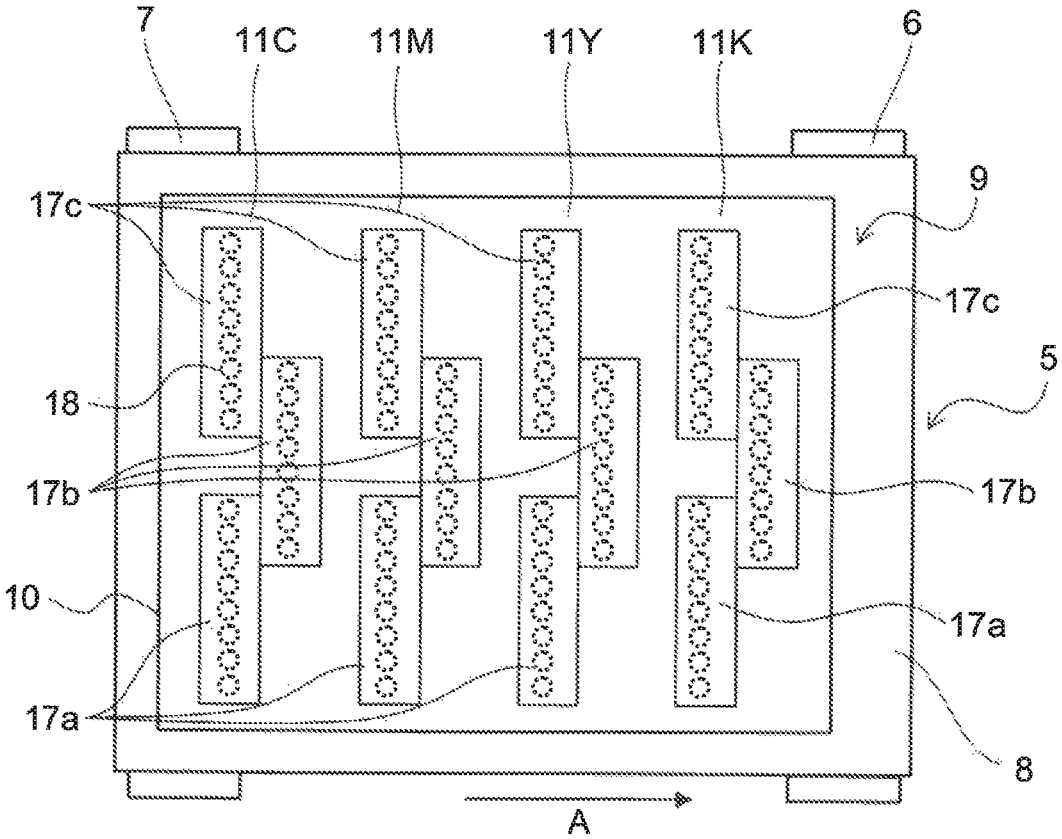
FIG. 2 is a plan view of a recording portion in the printer.
Figure 3:
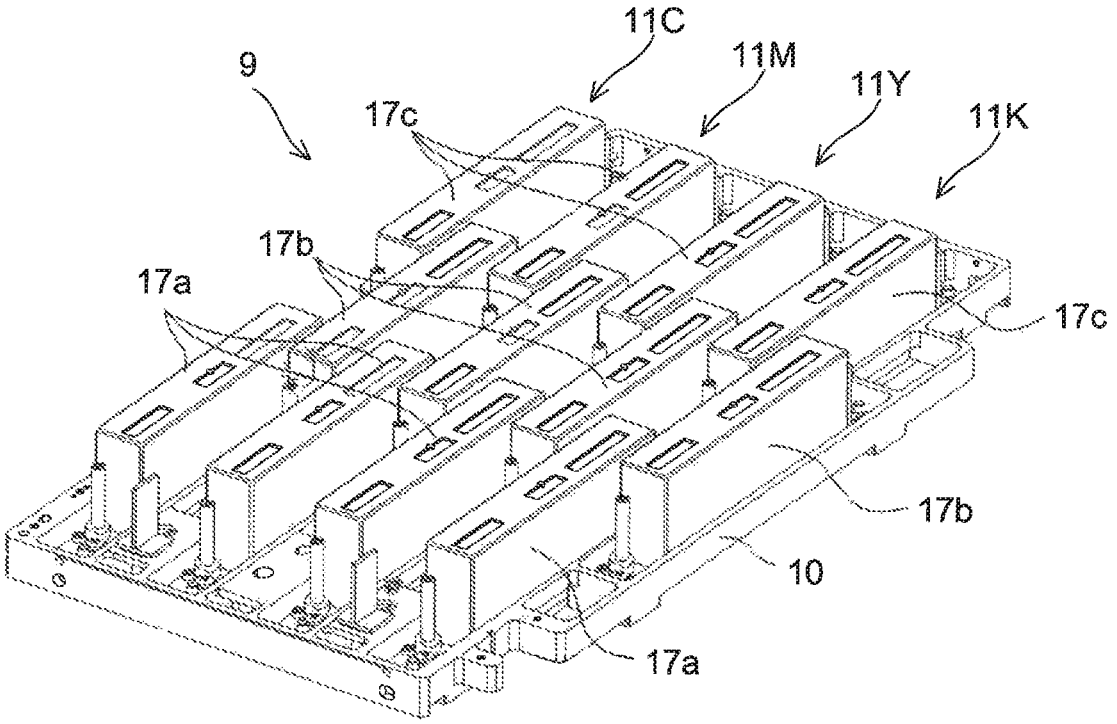
FIG. 3 is a perspective view of the recording portion.

As shown in FIGS. 2 and 3, the recording portion 9 includes a head housing 10 and line heads 11C, 11M, 11Y, and 11K held on the head housing 10. These line heads 11C to 11K are supported at such a height that a predetermined interval (e.g., 1 mm) is left from the conveying surface of a first conveying belt 8 that is wound around a plurality of rollers including a driving roller 6 and a driven roller 7, and each have a plurality of (here, three) recording heads 17*a* to 17*c* arranged in a staggered array along the sheet width direction (in FIG. 2, the up-down direction) perpendicular to the sheet conveying direction (the arrow A direction). The line heads 11C to 11K have a recording region equal to or larger than the width of the sheet P conveyed, and eject water-based ink (hereinafter referred to simply as the ink) from ejection nozzles 18 corresponding to printing positions toward the sheet P conveyed by the first conveying belt 8.

Figure 5:
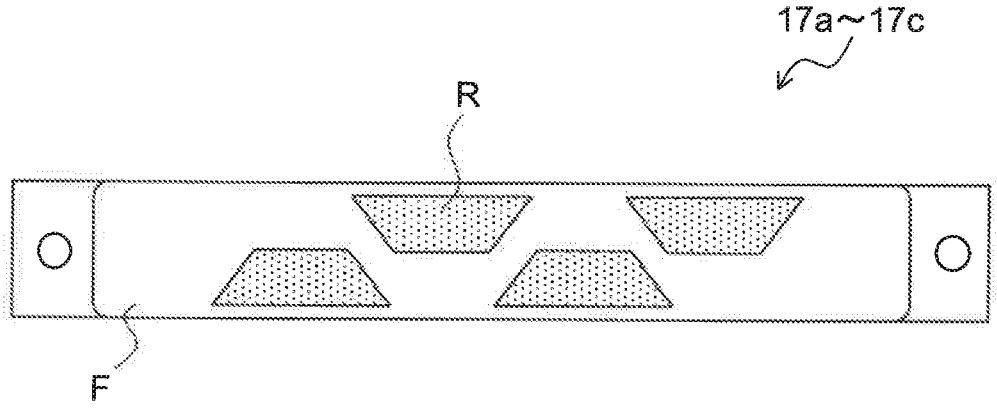
FIG. 5 is a bottom view schematically showing nozzle regions on the recording heads.

As shown in FIG. 5, the ink ejection surfaces F of the recording heads 17*a* to 17*c* have nozzle regions R in which a large number of ejection nozzles 18 are arrayed. The ink ejection surfaces F are lined with a water-repellent film (not shown). The recording heads 17*a* to 17*c* are shaped and structured identically, and therefore FIGS. 4 and 5 each show them in a single illustration.

The recording heads 17*a* to 17*c* constituting the line heads 11C to 11K are supplied with ink of four colors (cyan, magenta, yellow, and black) stored in ink tanks (not shown) such that the line heads 11C to 11K receive the ink of the corresponding colors respectively.

The recording heads 17*a* to 17*c* eject ink, according to image data received from an external computer, from the ejection nozzles 18 toward the sheet P conveyed in a state held by suction on the conveying surface of the first conveying belt 8. As a result, on the sheet P on the first conveying belt 8, a color image having ink of four colors, namely cyan, magenta, yellow, and black, overlaid on each other is formed.

With respect to the recording heads 17*a* to 17*c*, to prevent ink ejection failure due to drying and clogging, when printing is started after a long period of disuse, purging is performed in which ink with increased viscosity is exuded out of the ejection nozzles 18 of all the recording heads 17*a* to 17*c* in preparation for subsequent printing operation. Also between sessions of printing operation, purging is performed in which ink with increased viscosity is exuded out of the ejection nozzles 18 of any of the recording heads 17*a* to 17*c* that has ejected an amount of ink equal to or less than a prescribed amount.

Figure 6:
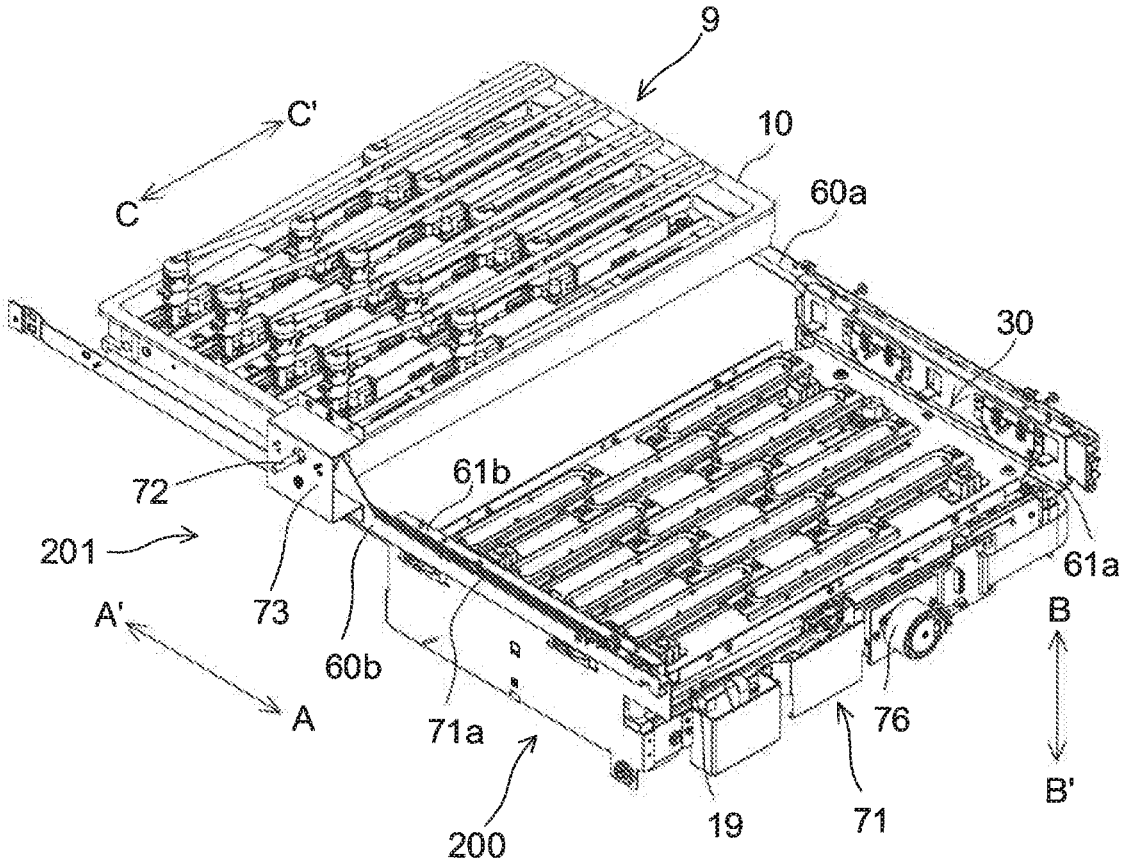
FIG. 6 is a perspective view showing a positional relationship between the recording portion and the maintenance unit before the maintenance unit in the maintenance device performs maintenance in which it wipes the ink ejection surfaces of the recording heads.

As shown in FIG. 6, under the recording portion 9, there are fixed two guide rails 60*a* and 60*b* that are parallel to each other along the sheet conveying direction (the arrow A direction). To the guide rails 60*a* and 60*b*, a pair of guide plates 61*a* and 61*b* is fixed. On lower-end parts of the guide plates 61*a* and 61*b*, side-end edges of the cap unit 30 are supported. On the guide rails 60*a* and 60*b*, a maintenance carriage 71 is slidably supported, and on the maintenance carriage 71, the maintenance unit 19 is placed. In this embodiment, the maintenance device 200 is configured to include the maintenance unit 19 and the maintenance carriage 71.

The cap unit 30 is configured to be reciprocally movable between a first position (the position in FIG. 14) right under the recording portion 9 and a second position (the position in FIG. 6) retracted from the first position in the horizontal direction (the arrow A direction), and to move up in the first position to cap the recording heads 17*a* to 17*c*.

Figure 7:
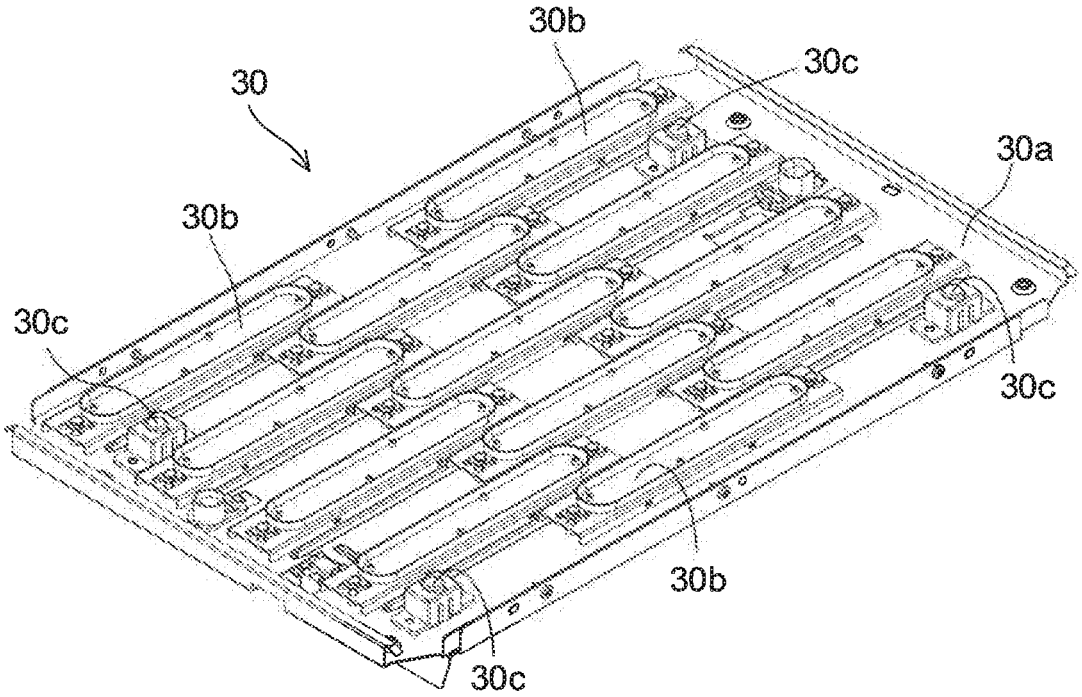
FIG. 7 is a perspective view of a cap unit that is attached to the recording heads.

Specifically, as shown in FIG. 7, the cap unit 30 includes a cap tray 30*a* formed of sheet metal, twelve concave cap portions 30*b* arranged on the top face of the cap tray 30*a*, and four height-direction positioning projections 30*c*.

The cap portions 30*b* are arranged at positions corresponding to the recording heads 17*a* to 17*c*. Thus, the cap unit 30 moving up in the first position results in the cap portions 30*b* capping the ink ejection surfaces F of the recording heads 17*a* to 17*c*. When the cap unit 30 is raised toward the recording portion 9 to cap the recording heads 17*a* to 17*c*, the height-direction positioning projections 30*c* make contact with a housing 10 (see FIG. 6) of the recording portion 9, and thereby keep steady contact between the cap portions 30*b* and the ink ejection surfaces F.

The maintenance unit 19 is configured to be reciprocally movable between a first position (the position in FIG. 14) right under the recording portion 9 and a second position (the position in FIG. 6) retracted from the first position in the horizontal direction (the arrow A direction), and to move up from the first position to perform wiping movement (described later).

Specifically, on the outer side of the guide rail 60*b*, there are fitted a drive motor 72 for moving the maintenance carriage 71 in the arrow AA' directions, a gear train (not shown) that meshes with the drive motor 72 and with rack teeth 71*a* on the maintenance carriage 71, and a cover member 73 that covers those. As the drive motor 72 rotates forward, the gear train is driven such that the maintenance carriage 71 moves, along with the maintenance unit 19, from the second position to the first position along the guide rails 60*a* and 60*b*. As the drive motor 72 rotates backward, the gear train is driven such that the maintenance carriage 71 moves, along with the maintenance unit 19, from the first position to the second position along the guide rails 60*a* and 60*b*. Here, the drive motor 72, the gear train, etc. constitute a unit movement mechanism 201 that reciprocally moves the maintenance carriage 71 and the maintenance unit 19 between the above-mentioned first position, where they, across an interval, face the ink ejection surfaces F of the recording heads 17*a* to 17*c*, and the above-mentioned second position, where they are retracted from the first position in the horizontal direction.

Figure 8:
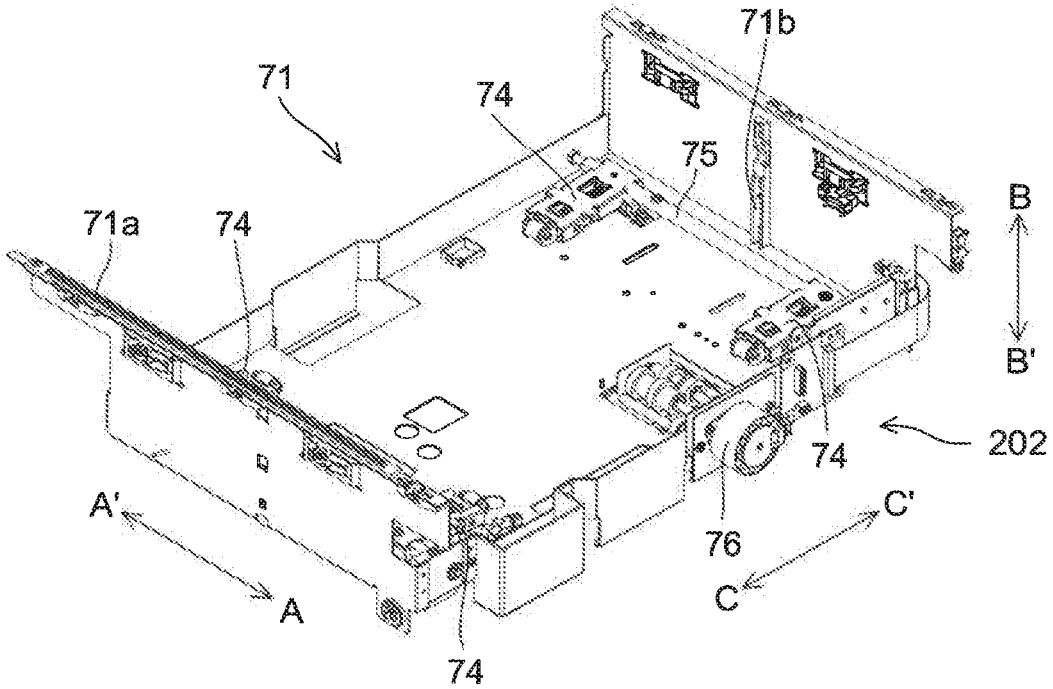
FIG. 8 is a perspective view of a maintenance carriage in the maintenance device in a state where support arms that support the maintenance unit from the bottom-face side are laid flat.
Figure 9:
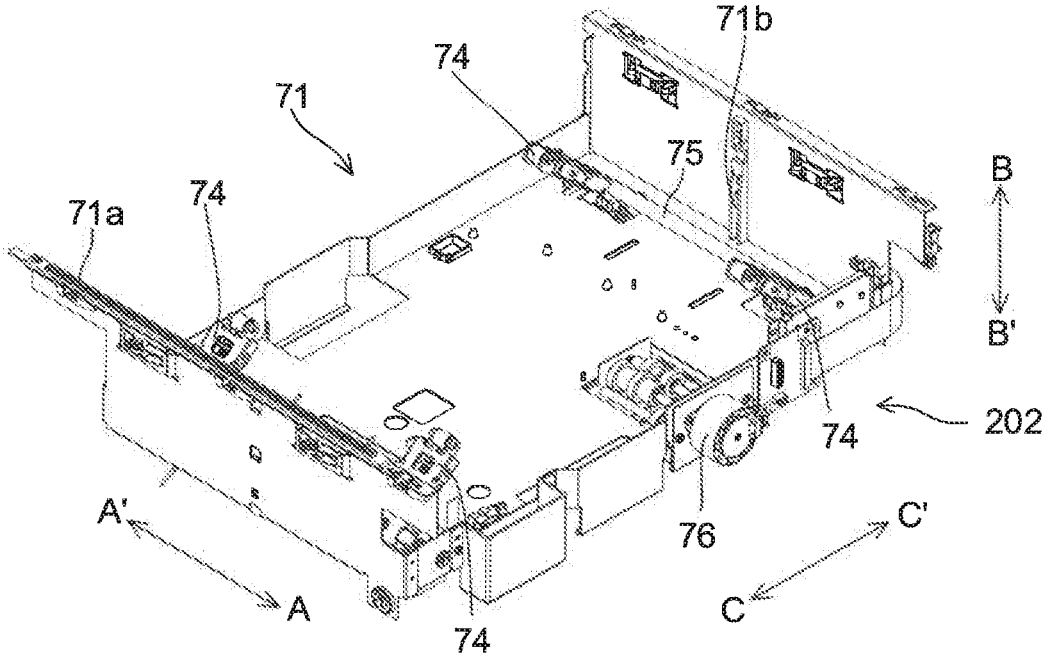
FIG. 9 is a perspective view of the maintenance carriage in a state where the support arms are raised upright.

In the four corners of a bottom part of the maintenance carriage 71, as shown in FIGS. 8 and 9, there are provided support arms 74 that support the maintenance unit 19 from its bottom-face side and that are swingable (can be raised upright or laid flat). Support arms 74 that are adjacent to each other in the arrow AA' directions are coupled together by a rotary shaft 75. On the outer side of the maintenance carriage 71, there are fitted a wipe ascent-descent motor 76 for swinging the support arms 74 and a gear train or the like (not shown) that meshes with the wipe ascent-descent motor 76 and with a gear on the rotary shaft 75. As the wipe ascent-descent motor 76 rotates forward, the gear train or the like is driven and the rotary shaft 75 rotates such that the support arm 74 swings (rises upright), This lets the maintenance unit 19 rise. As the wipe ascent-descent motor 76 rotates backward, the gear train or the like is driven and the rotary shaft 75 rotates such that the support arm 74 lies flat. This lets maintenance unit 19 lower. Here, the wipe ascent-descent motor 76, the gear train, the rotary shaft 75, the support arm 74, etc. constitute a unit ascent-descent mechanism 202 that makes the maintenance unit 19 ascend and descend in the up-down direction (the arrow BB' directions) between the first position mentioned above and a third position where the maintenance unit 19 is in contact with the plurality of recording heads 17*a* to 17*c*. On the inner face of the maintenance carriage 71, a guide groove 71*b* that extends in the up-down direction is formed, and the maintenance unit 19 ascends and descends in the up-down direction along the guide groove 71*b*.

Figure 10:
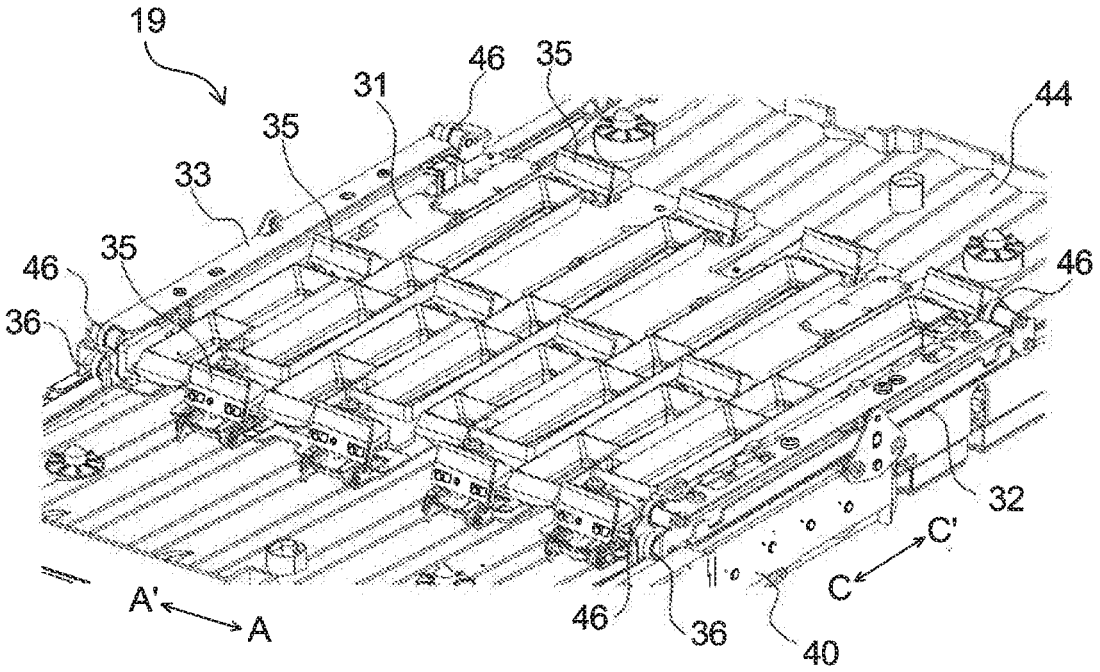
FIG. 10 is a perspective view showing the maintenance unit on an enlarged scale.
Figure 11:
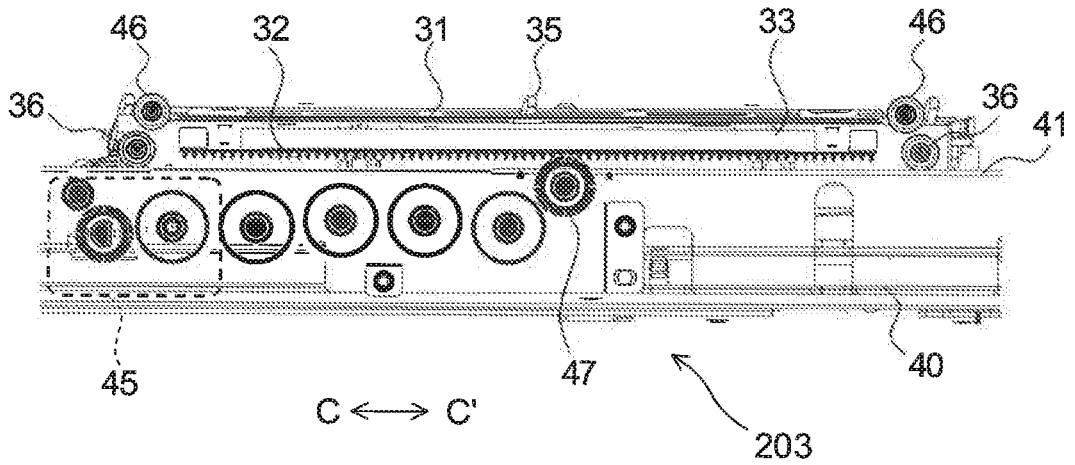
FIG. 11 is a sectional view showing a structure of a driving portion in the maintenance unit.
Figure 12:
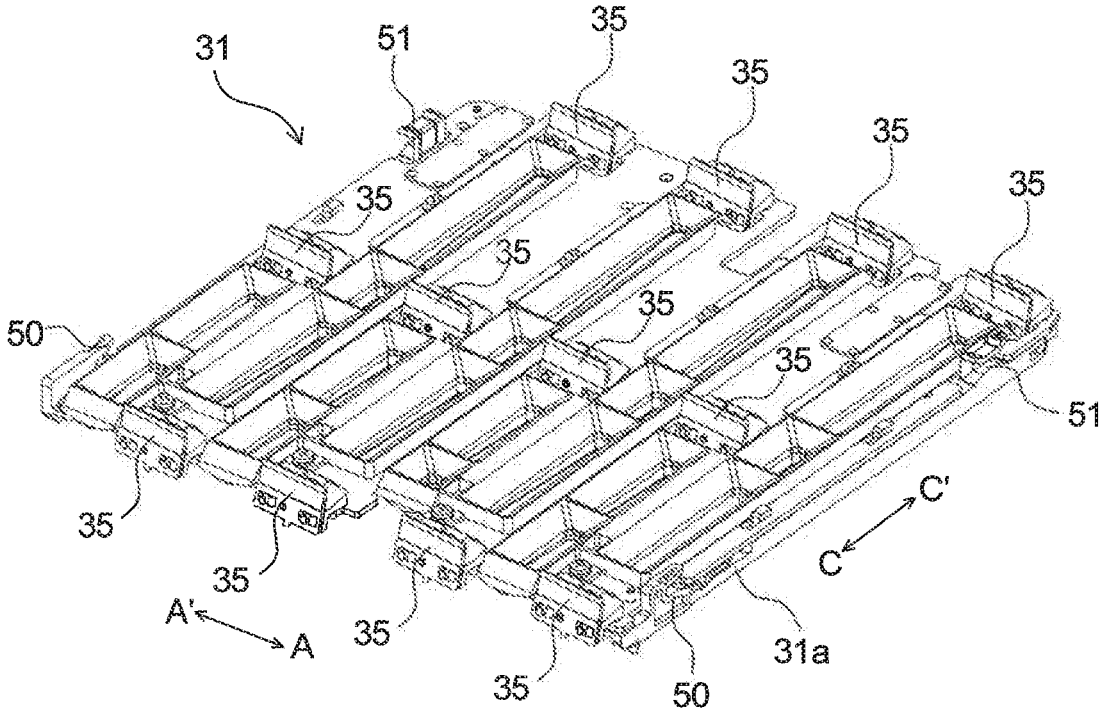
FIG. 12 is a perspective view of a blade unit provided in the maintenance unit.

FIG. 10 is a perspective view showing the maintenance unit 19 on an enlarged scale. FIG. 11 is a sectional view showing the structure of a driving portion of the maintenance unit 19. FIG. 12 is a perspective view of a blade unit 31 provided in the maintenance unit 19. The maintenance unit 19 is composed of a blade unit 31 to which a plurality of wiping blades (wipers) 35 are fixed, a wiper carriage 33 substantially in a rectangular shape to which the blade unit 31 is attached, and a support frame 40 that supports the wiper carriage 33. The structure of the wiper carriage 33 will be described in detail later.

As shown in FIGS. 10 and 11, at side-end edges of the top face of the support frame 40 opposite from each other in the arrow AA' directions, rail grooves 41 are respectively formed in the arrow CC' directions. The arrow CC' directions are directions perpendicular to the arrow AA' directions on a plane parallel to the ink ejection surfaces F of the plurality of recording heads 17*a* to 17*c*. In particular, the arrow C direction corresponds to the direction in which the plurality of wiping blades 35 wipes the ink ejection surfaces F. Slide rollers 36 provided at four places (In FIG. 10, two places on the A-direction side and two places on the A'-direction side) on the wiper carriage 33 make contact with the rail grooves 41 so that the wiper carriage 33 is supported so as to be slidable in the arrow CC' directions with respect to the support frame 40.

To the support frame 40 are fitted a wiper drive motor 45 for moving the wiper carriage 33 in the horizontal direction (the arrow CC' direction) and a rack drive gear 47 that meshes with a rack 32 on the wiper carriage 33. As the wiper drive motor 45 rotates forward or backward, via the gear train, the rack drive gear 47 rotates forward or backward, so that the wiper carriage 33 moves reciprocally in the horizontal direction (the arrow CC' directions). The wiper drive motor 45, the rack drive gear 47, etc. constitute a wiper movement mechanism 203 that moves the wiper carriage 33 in the direction in which the plurality of wiping blades 35 wipe the ink ejection surfaces F of the plurality of recording heads 17*a* to 17*c*.

On the top face of the support frame 40, an ink collection tray 44 (see FIG. 10) for collecting the waste ink wiped off from the ink ejection surfaces F by the wiping blades 35 is arranged. Substantially in a central part of the ink collection tray 44, an ink discharge hole (not shown) is formed, and the tray surface is, on either side of the ink discharge hole, sloped down toward the ink discharge hole. The waste ink wiped off from the ink ejection surfaces F by the wiping blades 35 and fallen on the tray surface flows toward the ink discharge hole. The waste ink then passes through an ink collection passage (not shown) connected to the ink discharge hole and is collected in a waste ink collection tank (not shown).

The wiping blades 35 are rubber members formed of, for example, EPDM for wiping off the ink exuded out of the ejection nozzles 18 in the recording heads 17*a* to 17*c*. The wiping blades 35 are pressed, substantially from the vertical direction, against a wiping start position outside the nozzle regions R (see FIG. 5), where the ejection nozzles 18 are exposed, and as the wiper carriage 33 moves, the wiping blades 35 wipes the ink ejection surfaces F, including the nozzle regions R, in a predetermined direction (the arrow C direction).

As shown in FIG. 12, a total of twelve of the wiping blades 35 are arranged, four of them at substantially equal intervals in the width direction (the arrow AA' directions) of a unit body 31*a* of the blade unit 31 in each of three rows in the movement direction (the arrow CC' directions) of the wiper carriage 33. The wiping blades 35 are arranged respectively at positions corresponding to the recording heads 17*a* to 17*c* (see FIG. 3) constituting the line heads 11C to 11K. The blade unit 31 is detachably attached to the wiper carriage 33, and thus, when the wiping blades 35 are worn or broken, they are replaced integrally with the unit body 31*a*.

On the opposite side faces of the unit body 31*a* parallel to the movement direction of the wiper carriage 33, there are formed first engagement portions 50 and second engagement portions 51 respectively. The first engagement portions 50 are arranged on the upstream side of the second engagement portions 51 with respect to the attachment direction (the arrow C' direction) of the blade unit 31. The first and second engagement portions 50 and 51 engage respectively with protruding pins (not shown) provided on the wiper carriage 33, and thereby the blade unit 31 is positioned relative to the wiper carriage 33.

Figure 13:
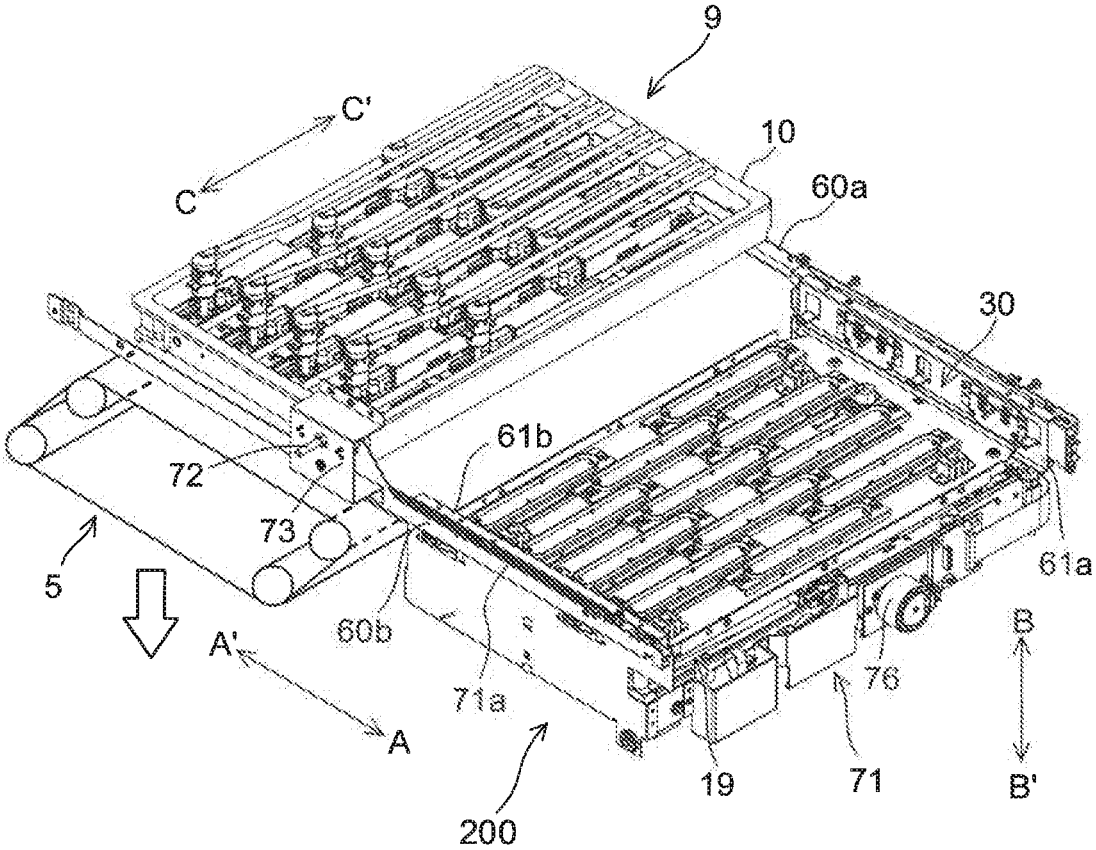
FIG. 13 is a perspective view of a first belt conveying portion before it is lowered from a position where it faces the recording portion.

Next, a description will be given of the operation of attaching the cap unit 30 to the recording heads 17*a* to 17*c* in the printer 100 according to the embodiment. When the recording heads 17*a* to 17*c* are capped with the cap unit 30, as shown in FIG. 13, the first belt conveying portion 5, which is arranged to face the bottom face of the recording portion 9, is lowered.

Figure 14:
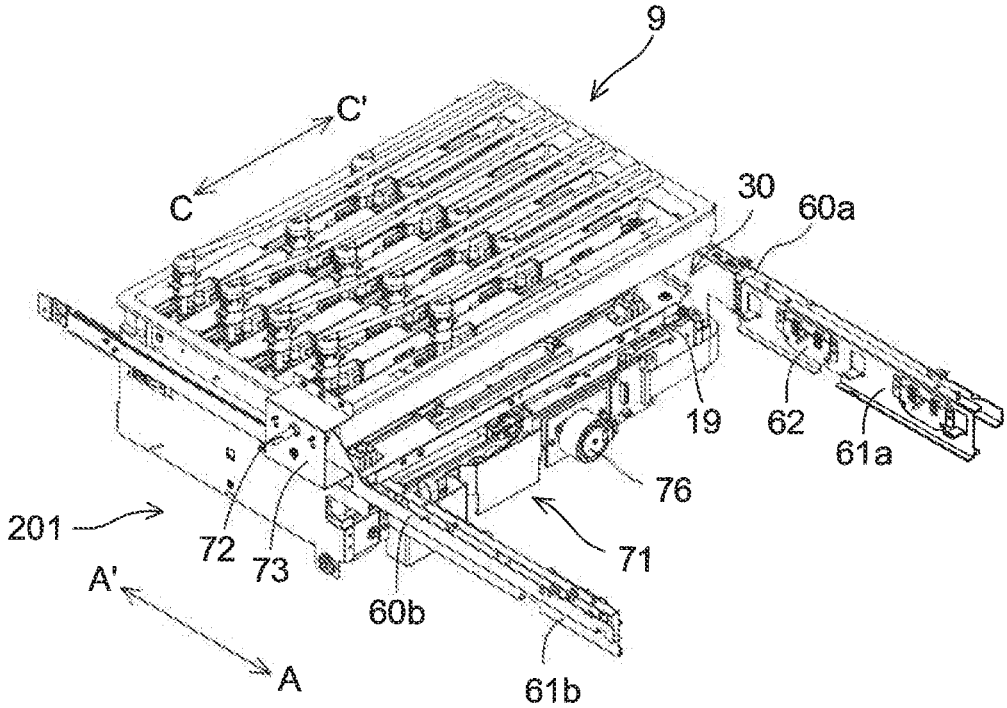
FIG. 14 is a perspective view showing a state where, with the cap unit arranged over the maintenance unit, the maintenance unit and the cap unit have been moved to right under the recording portion.

Then, as shown in FIG. 14, with the cap unit 30 arranged over the maintenance unit 19, the maintenance unit 19 and the cap unit 30 are moved from the second position to the first position by the unit movement mechanism 201. Thereafter, the maintenance unit 19 and the cap unit 30 are raised by the unit ascent-descent mechanism 202 (see FIGS. 8 and 9), so that the cap unit 30 (cap portions 30*b*) is attached to the recording heads 17*a* to 17*c*.

Figure 15:
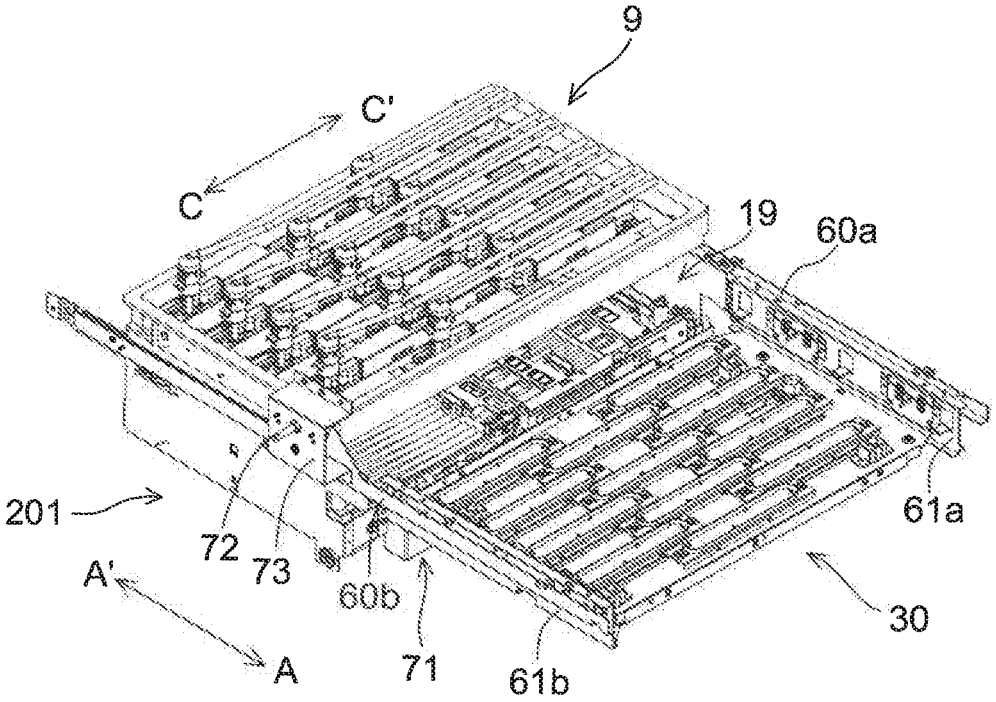
FIG. 15 is a perspective view showing a state where only the maintenance unit has been moved to right under the recording portion.

Next, a description will be given of recovery operation for the recording heads 17*a* to 17*c* in the printer 100 according to the embodiment. When recovery operation for the recording heads 17*a* to 17*c* is performed with the maintenance unit 19, as shown in FIG. 13, the first belt conveying portion 5, which is arranged to face the bottom face of the recording portion 9, is lowered. Then, as shown in FIG. 15, with the cap unit 30 left behind at the second position, the maintenance unit 19 is moved from the second position to the first position by the unit movement mechanism 201.

Figure 16:
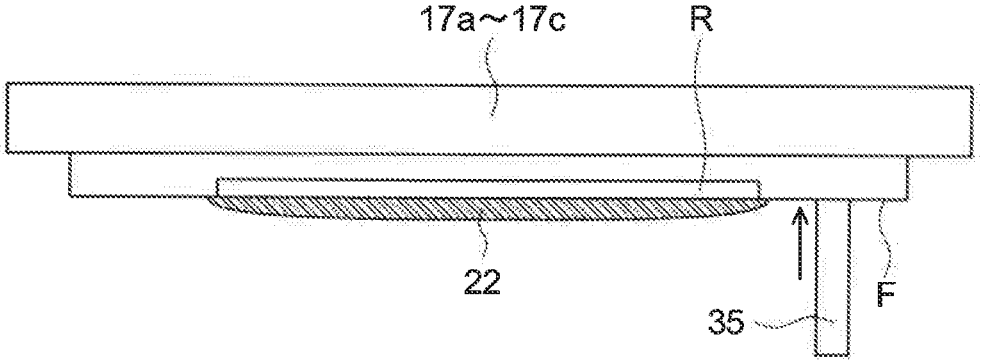
FIG. 16 is a sectional view showing a state of the ink ejection surfaces of the recording heads after purging operation.

Before wiping movement, ink is supplied to the recording heads 17*a* to 17*c*. The supplied ink is, as shown in FIG. 16, forcibly exuded (purged) out of the ejection nozzles 18. In FIG. 16, the ink forcibly exuded out of the ejection nozzles 18 is indicated by the reference sign 22. Through this purging operation, ink with increased viscosity, foreign matter, and air bubbles in the ejection nozzles 18 are discharged, and this achieves recovery of the recording heads 17*a* to 17*c*.

Next, wiping movement is performed in which the ink 22 discharged onto the ink ejection surfaces F is wiped off. Specifically, the maintenance unit 19 is raised by the unit ascent-descent mechanism 202 (see FIGS. 8 and 9) and thereby, as shown in FIG. 16, the wiping blades 35 are pressed against the wipe start position on the ink ejection surfaces F of the recording heads 17*a* to 17*c*.

Figure 17:
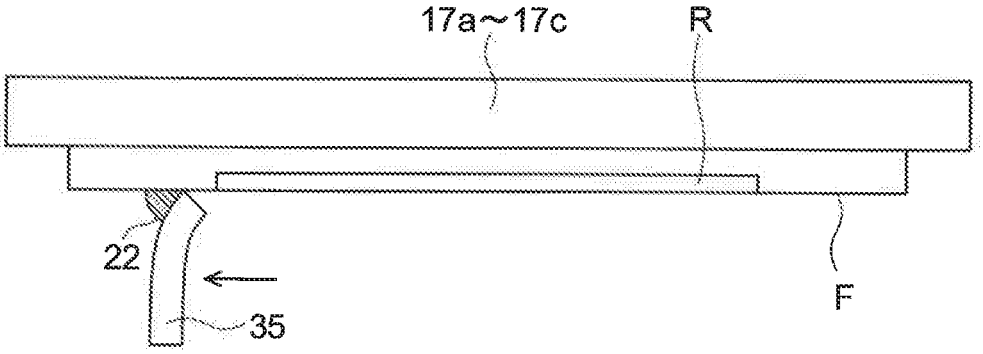
FIG. 17 is a sectional view showing a state where, after purging operation, wiping blades in the maintenance unit have wiped off the ink exuded onto the ink ejection surfaces.

Then the wiper carriage 33 is moved horizontally in the arrow C direction by the wiper drive motor 45 (see FIG. 11). In this way, as shown in FIG. 17, the wiping blades 35 wipe off the ink 22 exuded onto the ink ejection surfaces F of the recording heads 17*a* to 17*c*.

When the wiping blades 35 have moved up to a downstream-side end part of the ink ejection surfaces F of the recording heads 17*a* to 17*c*, the wiper carriage 33 is lowered by the unit ascent-descent mechanism 202. Thus, the wiping blades 35 are retracted from the ink ejection surfaces F of the recording heads 17*a* to 17*c*.

Thereafter, the maintenance unit 19 is moved from the first position in the arrow A direction in FIG. 15 by the unit movement mechanism 201. Now, the maintenance unit 19 is arranged at a predetermined position (the second position) right under the cap unit 30.

Details of Wiper Carriage

Figure 18:
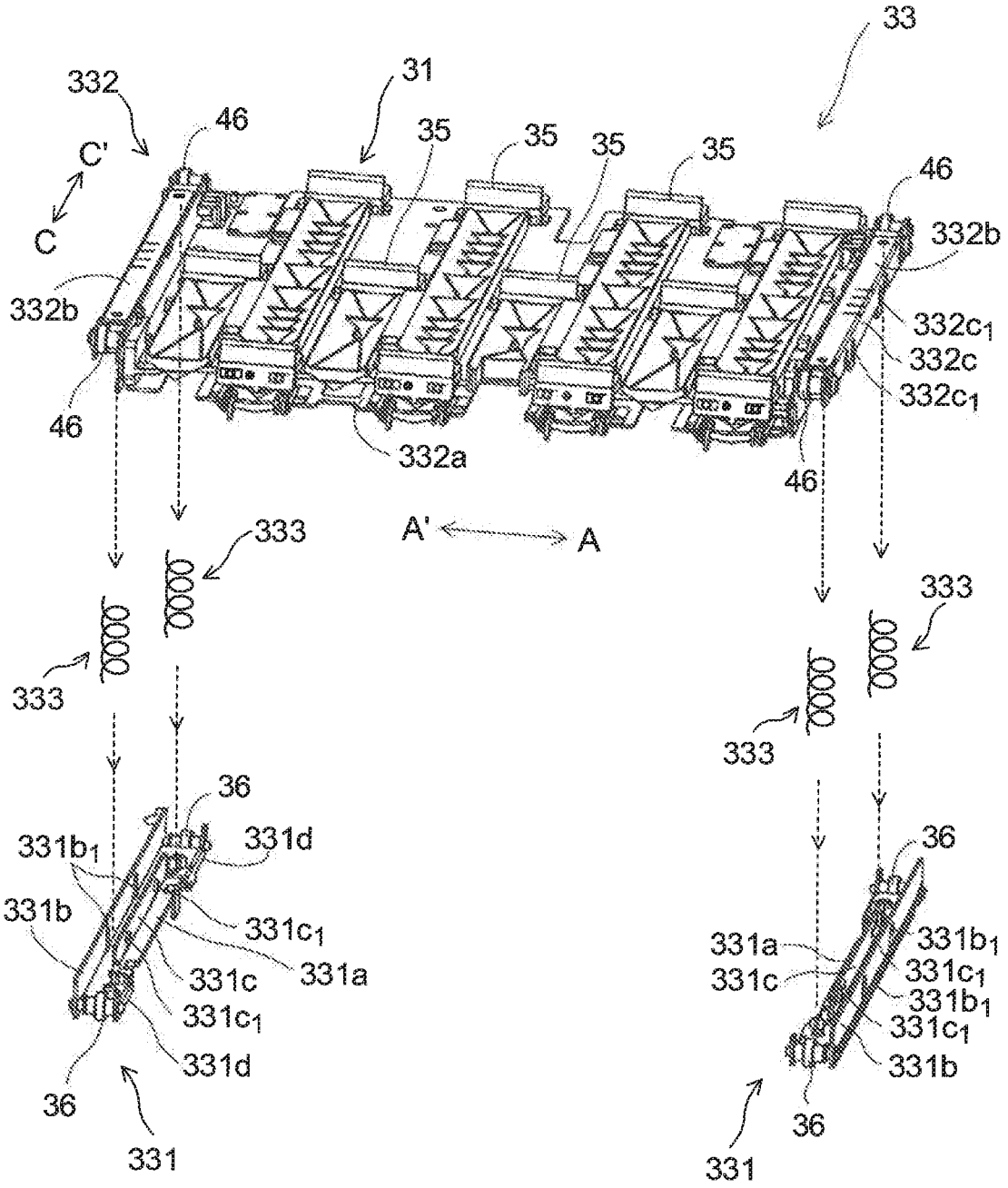
FIG. 18 is a perspective view showing the wiper carriage disassembled.

Next, the wiper carriage 33 described above will be described in detail. FIG. 18 is a perspective view showing the wiper carriage 33 disassembled. The wiper carriage 33 is composed of two stationary portions 331, a movable portion 332, and coil springs 333.

Each stationary portion 331 has a flat plate portion 331*a* (stationary-side flat plate portion), an outer wall 331*b*, and an inner wall 331*c*. The flat plate portion 331*a* extends, in the shape of a flat plate, in the movement direction (the arrow CC' directions) of the wiper carriage 33 by the wiper movement mechanism 203 (see FIG. 11). The outer wall 331*b* extends upright from an outer side-edge part of the flat plate portion 331*a* in its width direction (arrow AA' directions) and extends in the arrow CC' directions. The outer wall 331*b* is longer than the flat plate portion 331*a* in the arrow CC' directions. In the outer wall 331*b*, two hole portions $\mathbf{331}b_1$ are formed away from each other in the arrow CC' directions. Positioning pins 334 (described later; see FIG. 21 and FIG. 29) are inserted via the hole portions 331*b*, to be fixed to the inner wall 331*c*.

The inner wall 331*c* extends upright from a central part of the flat plate portion 331*a* in its width direction, parallel to and away from the outer wall 331*b*, and extends in the arrow CC' directions. The inner wall 331*c* is shorter than the flat plate portion 331*a* in the arrow CC' directions. In the inner wall 331*c*, at positions corresponding to the hole portions 331*b*1 in the outer wall 331*b*, two through holes $\mathbf{331}c_1$ are formed away from each other in the arrow CC' directions. The positioning pins 334 inserted via the hole portions $\mathbf{331}b_1$ in the outer wall 331*b* are fixed by being inserted in the through holes $\mathbf{331}c_1$. Thus, the inner wall 331*c* constitutes a stationary-side wall portion to which the positioning pins 334 inserted in holes $\mathbf{331}c_1$ are fixed.

At opposite end parts of the flat plate portion 331*a* in the arrow CC' directions, support walls 331*d* are respectively formed to rotatably support slide rollers 36 against the outer wall 331*b*. Thus, two slide rollers 36 are located away from each other in the arrow CC' directions on the stationary portion 331.

In the flat plate portion 331*a*, at positions closer to the outer wall 331*b* than the through holes $\mathbf{331}c_1$ in the inner wall 331*c*, hole portions $\mathbf{331}a_1$ (see FIG. 26) are formed so as to penetrate in the up-down direction. Projection portions $\mathbf{332}c_2$ (described later; see FIG. 21) provided on the movable portion 332 are fitted into and pulled out of the hole portions $\mathbf{331}a_1$ as the maintenance unit 19 is raised and lowered by the unit ascent-descent mechanism 202 (see FIGS. 8 and 9).

The movable portion 332 supports the blade unit 31, and has positioning rollers 46. When the maintenance unit 19 is moved from the first position to the third position by the unit ascent-descent mechanism 202, the positioning rollers 46 make contact with the housing 10 (FIG. 3) that holds the plurality of recording heads 17*a* to 17*c*, and thereby restrict the position of the plurality of wiping blades 35 in their receding direction relative to the ink ejection surfaces F of the recording heads 17*a* to 17*c*.

The movable portion 332, configured as described above, has a carriage body 332*a* to which the blade unit 31 is attached and, in opposite side-edge parts of the carriage body 332*a* in the arrow AA' directions, flat plate portions 332*b* (movable-side flat plate portions) that extend along the arrow CC' directions. The carriage body 332*a* has, between one flat plate portion 332*b* and the other flat plate portion 332*b*, a bent shape with a substantially concave section. Thus, when the blade unit 31 is attached to the carriage body 332*a*, the blade unit 31 is located between one flat plate portion 332*b* and the other flat plate portion 332*b* in the arrow AA' directions.

One and the other flat plate portions 332*b* of the movable portion 332 are so located as to face respectively the one and the other flat plate portions 331*a* of the stationary portion 331 in the ascent-descent direction (corresponding to the up-down direction in FIG. 18) of the maintenance unit 19 by the unit ascent-descent mechanism 202.

The movable portion 332 has wall portions 332*c* (movable-side wall portions) extending upright from the flat plate portions 332*b* respectively. The wall portions 332*c* extend along the arrow CC' directions, and each have two through holes $\mathbf{332}c_1$ at positions away from each other in the arrow CC' directions. The through holes $\mathbf{332}c_1$ are elongate in the ascent-descent direction of the maintenance unit 19 by the unit ascent-descent mechanism 202. In the through holes $\mathbf{332}c_1$, positioning pins 334 (described later) are inserted. The wall portions 332*c* of the movable portion 332 are located between the outer walls 331*b* and the inner walls 331*c* of the stationary portions 331.

On the wall portions 332*c*, right under the through holes $\mathbf{332}c_1$, projection portions $\mathbf{332}c_2$ (see FIG. 21) that are fitted into and pulled out of the hole portions $\mathbf{331}a_1$ in the stationary portions 331 are formed so as to protrude downward.

The coil springs 333 are elastic members that elastically support the movable portion 332 relative to the stationary portions 331, and expand and contract in the ascent-descent direction of the maintenance unit 19 by the unit ascent-descent mechanism 202. The coil springs 333 are located respectively between one and the other flat plate portions 332*b* of the movable portion 332 and one and the other flat plate portions 331*a* of the stationary portions 331. In the embodiment, between the flat plate portion 332*b* and the flat plate portion 331*a*, two coil springs are located away from each other in the arrow CC' directions, so that a total of four coil springs 333 are provided. Between the flat plate portion 332*b* and the flat plate portion 331*a*, three or more coil springs 333 may be provided in a row. For the sake of simple structure, however, it is preferable that as few coil springs 333 as possible be provided.

On the flat plate portion 331*a* of the stationary portion 331, spring buckling prevention bosses 331*e* (see FIG. 25 etc.) are provided. The spring buckling prevention bosses 331*e* are fixed by being fitted in, from below (from the side opposite from the flat plate portion 332*b* of the movable portion 332 relative to the flat plate portion 331*a* of the stationary portion 331), the hole portions $\mathbf{331}a_2$ formed in the flat plate portion 331*a*. Locating the spring buckling prevention bosses 331*e* inside the coil springs 333 prevents buckling deformation of the coil springs 333.

On the flat plate portion 332*b* of the movable portion 332, position restricting guides 332$b_1$ (see FIGS. 21 and 25) are provided. The position restricting guides 332$b_1$ are formed by forming holes in parts of the flat plate portion 332*b* and bending the edges around the holes downward (to the side where the stationary portion 331 faces the flat plate portion 331*a*). Fitting the coil spring 333 around the position restricting guide 332$b_1$ prevents displacement of the coil springs 333 relative to the flat plate portion 332*b*.

Figure 21:
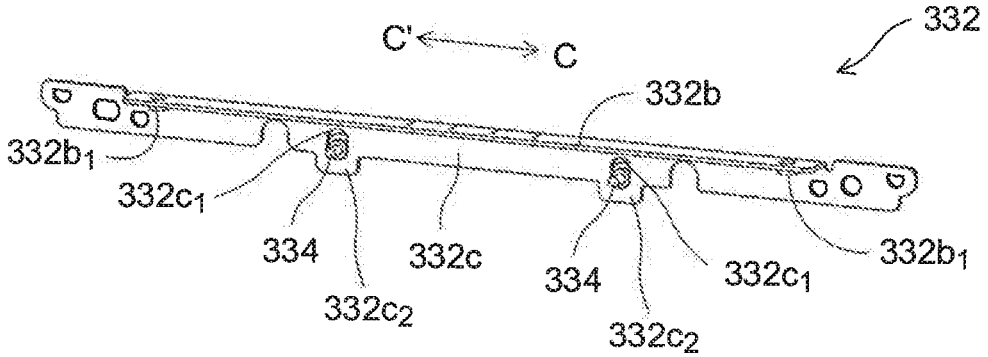
FIG. 21 is a perspective view showing a relative positional relationship between positioning pins on the wiper carriage and movable portions during non-wiping.
Figure 29:
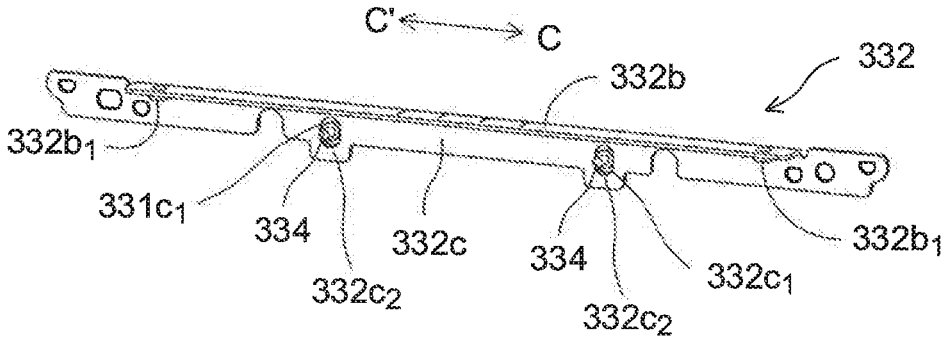
FIG. 29 is a perspective view showing a relative positional relationship between the positioning pins and the movable portions during wiping.

The wiper carriage 33 further has positioning pins 334 (see FIGS. 21 and 29). The positioning pins 334 are pins for restricting the movement of the movable portion 332 in its ascent-descent direction relative to the stationary portion 331, and are inserted in the through holes 332$c_1$ in the wall portions 332*c* of the movable portion 332 and are fixed by being inserted in the through holds 331$c_1$ in the inner walls 331*c* of the stationary portions 331. The through holes 332$c_1$ in the movable portion 332 are, as mentioned above, elongate in the ascent-descent direction mentioned above, and this enables the wall portions 332*c* to ascend until the positioning pins 334 make contact with lower end portions of the through holes 332$c_1$ and to descend until the positioning pins 334 make contact with upper end parts of the through holes 332$c_1$. That is, contact of the positioning pins 334 with upper end parts or lower end parts of the through holes 332$c_1$ restricts the movement of the movable portion 332 in the ascent-descent direction relative to the stationary portions 331.

Behavior of Wiper Carriage

Next, a description will be given of the behavior of the wiper carriage 33 other than during the wiping of the ink ejection surfaces F by the wiping blades 35 (hereinafter referred to as "during non-wiping") and during the wiping of the ink ejection surfaces F (hereinafter referred to as "during wiping").

Figure 19:
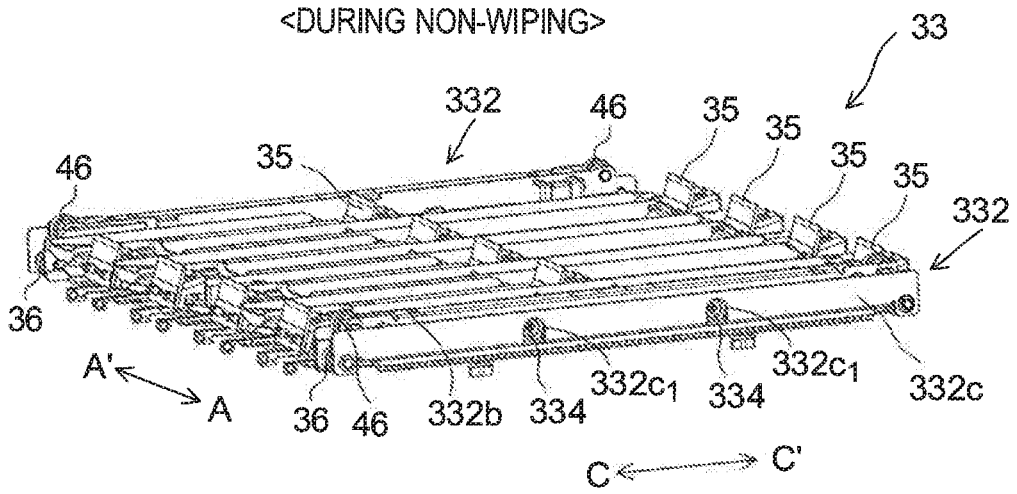
FIG. 19 is a perspective view of the wiper carriage during non-wiping.
Figure 20:
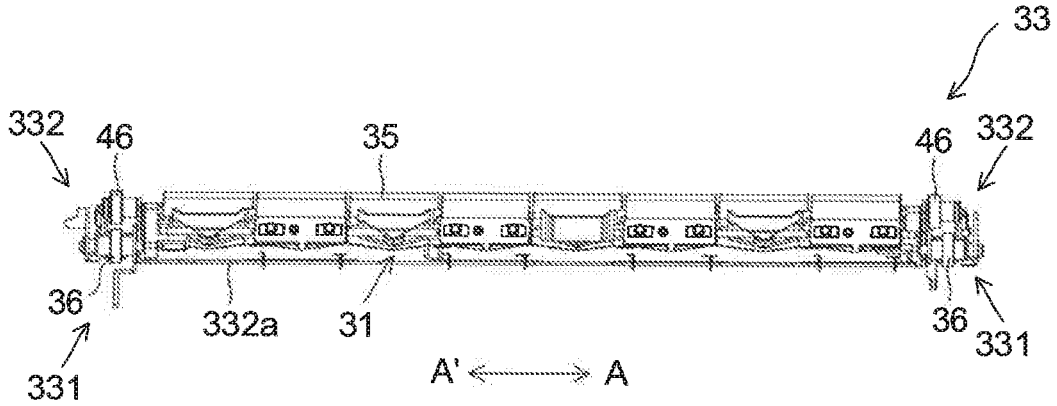
FIG. 20 is a front view of the wiper carriage during non-wiping.
Figure 22:
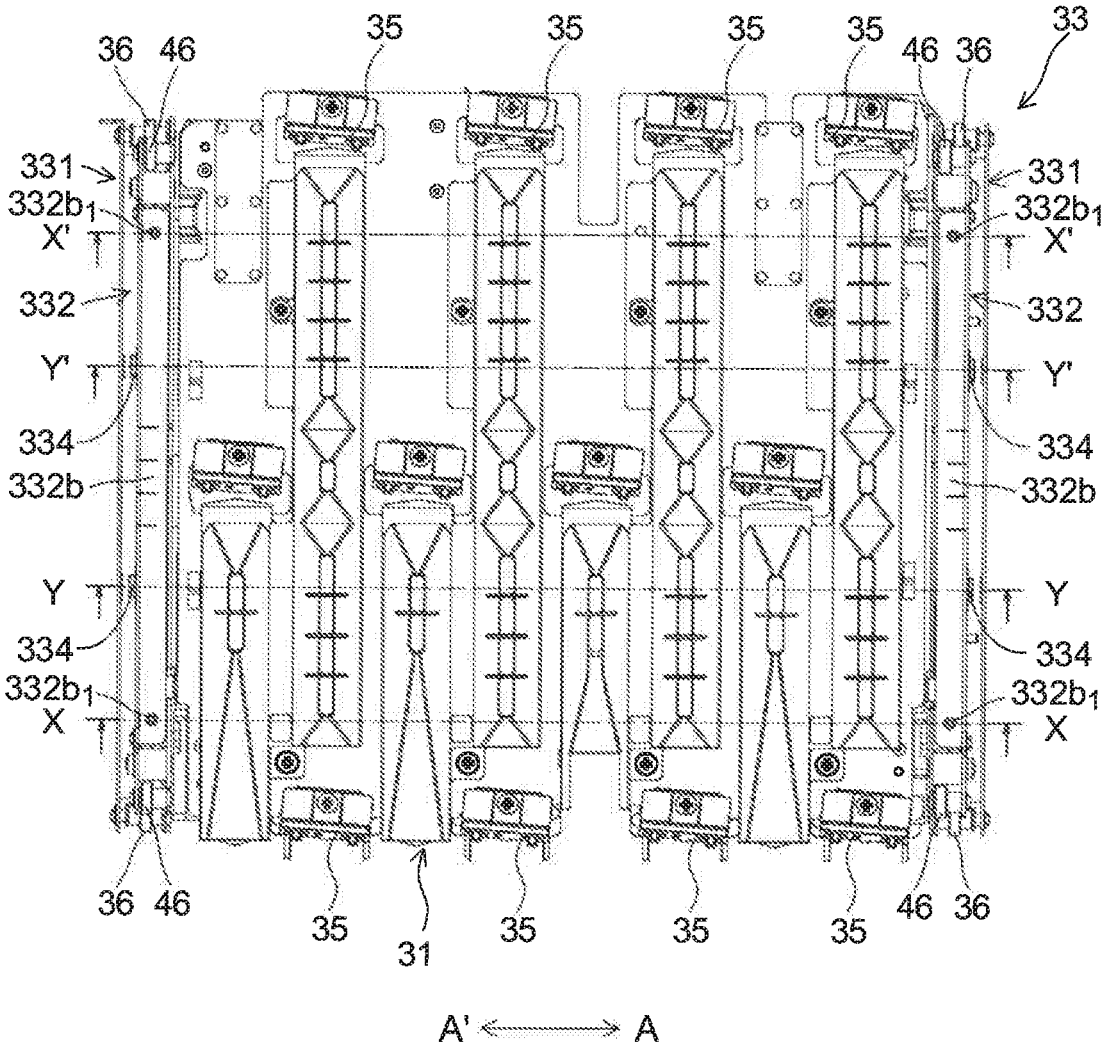
FIG. 22 is a plan view of the wiper carriage during wiping.
Figure 23:
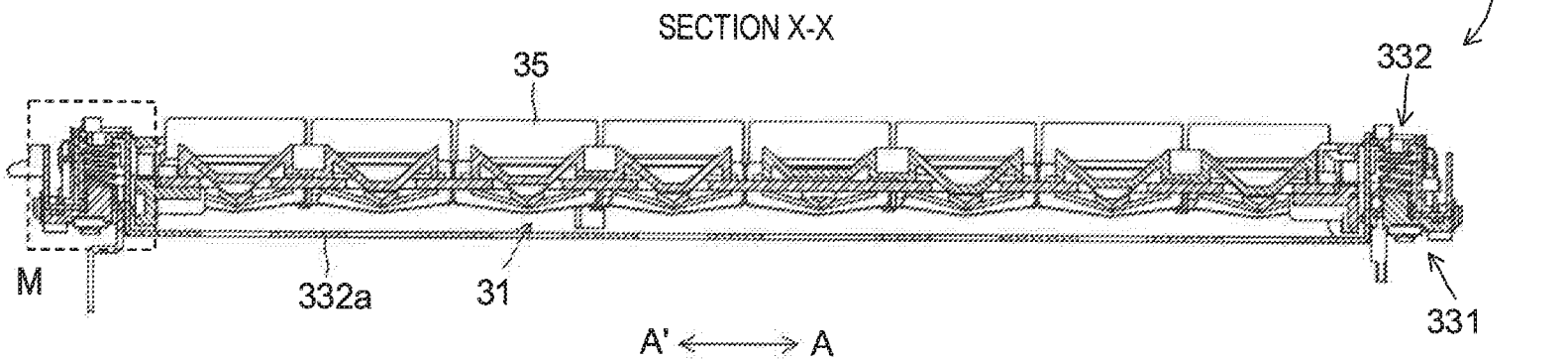
FIG. 23 is a sectional view across line X-X in FIG. 22.
Figure 24:
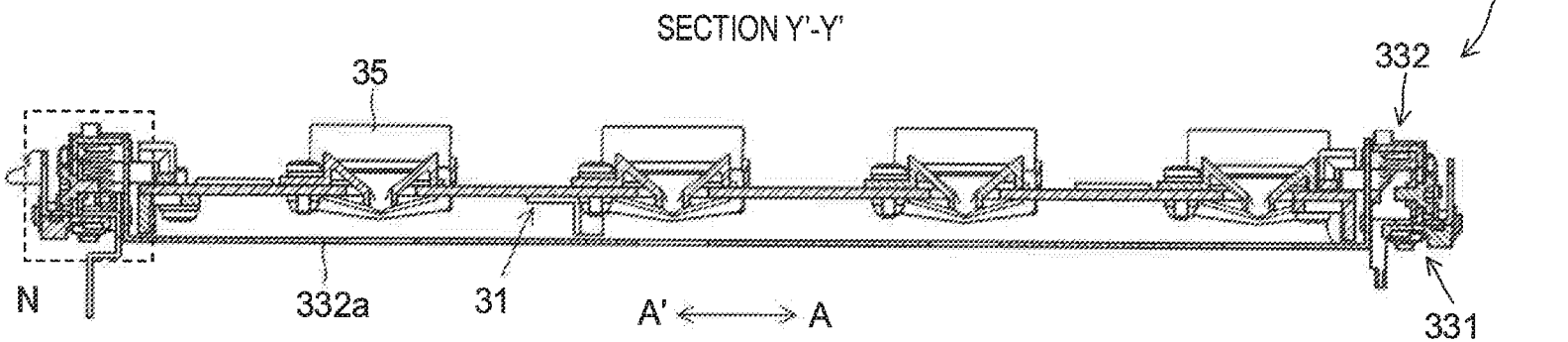
FIG. 24 is a sectional view across line Y'-Y' in FIG. 22.
Figure 25:
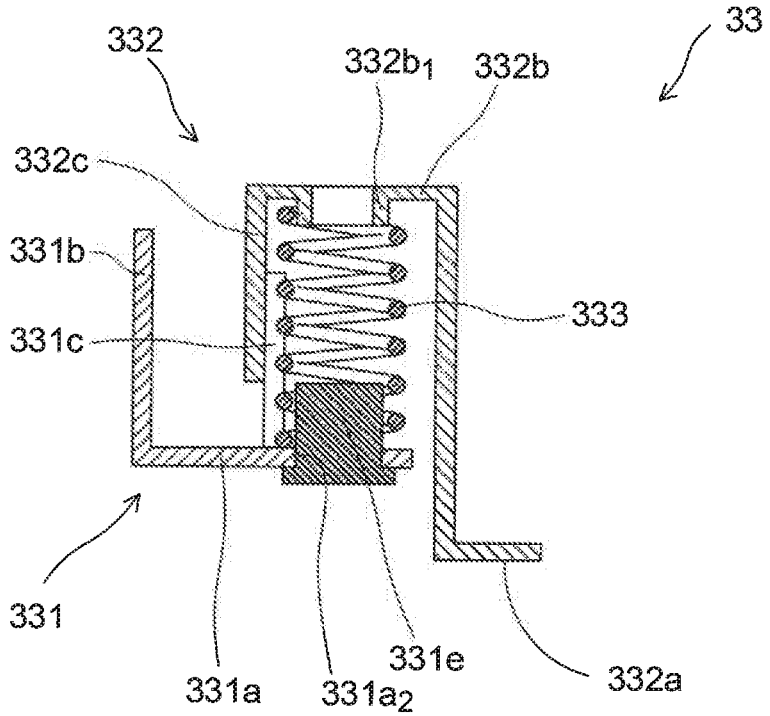
FIG. 25 is a sectional view showing part M in FIG. 23 in a simplified form on an enlarged scale.
Figure 26:
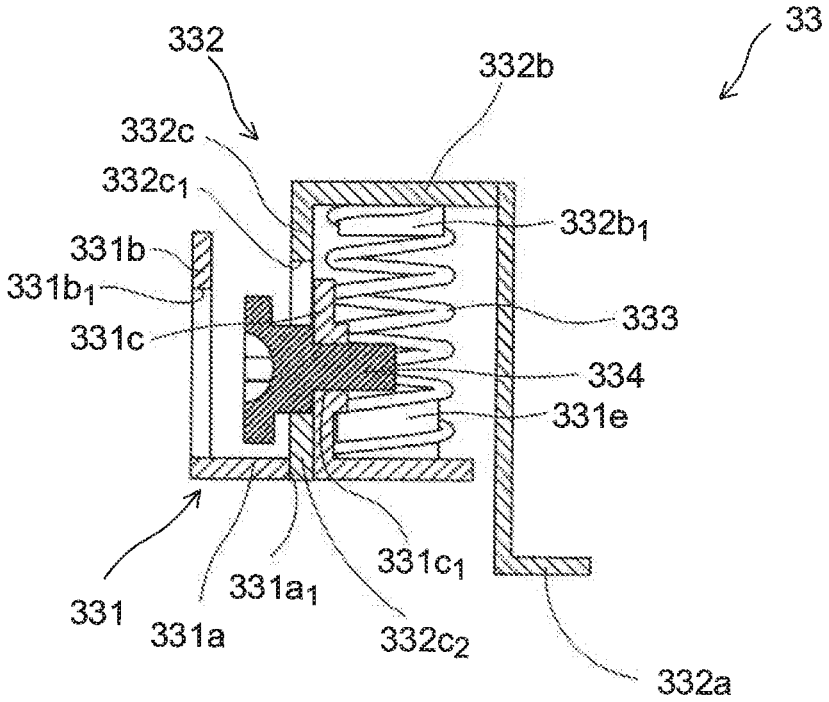
FIG. 26 is a sectional view showing part N in FIG. 24 in a simplified form on an enlarged scale.

FIGS. 19 and 20 are a perspective view and a front view, respectively, of the wiper carriage 33 during non-wiping, and FIG. 21 is a perspective view showing a relative positional relationship between the positioning pins 334 and the movable portion 332 during non-wiping. FIG. 22 is a plan view of the wiper carriage 33 during non-wiping, FIG. 23 is a sectional view across line X-X in FIG. 22, and FIG. 24 is a sectional view across line Y'-Y' in FIG. 22. FIG. 25 is a sectional view showing part M in FIG. 23 in a simplified form on an enlarged scale, and FIG. 26 is a sectional view showing part N in FIG. 24 in a simplified form on an enlarged scale.

The sectional views in FIGS. 23 and 24 are generally the same as the sectional views across lines X'-X' and Y-Y, respectively, in FIG. 22 except that the wiping blades 35 exhibit different appearances. The sections across lines X-X and X'-X' in FIG. 22 intersect the position restricting guides 332$b_1$ and the spring buckling prevention bosses 331*e* around which the coil springs 333 are fitted. On the other hand, the sections across lines Y-Y and Y'-Y' in FIG. 22 intersect the positioning pins 334.

It is possible to assume, as a state during non-wiping, for example, a state where the maintenance unit 19 is located at the first or second position and the wiping blades 35 are not in contact with the ink ejection surfaces F of the recording heads 17*a* to 17*c*. During non-wiping, the coil springs 333 expand, with a result that the flat plate portions 332*b* of the movable portion 332 are pushed up relative to the flat plate portions 331*a* of the stationary portions 331. Thus, as shown in FIG. 21, the movable portion 332 ascends until the positioning pins 334 make contact with lower end parts of the through holes 332$c_1$ in the wall portions 332*c*. In this state, no downward pressing force acts on the movable portion 332, and thus the coil springs 333 are kept in the state expanded upward relative to the stationary portions 331 (see FIGS. 25 and 26).

Figure 27:
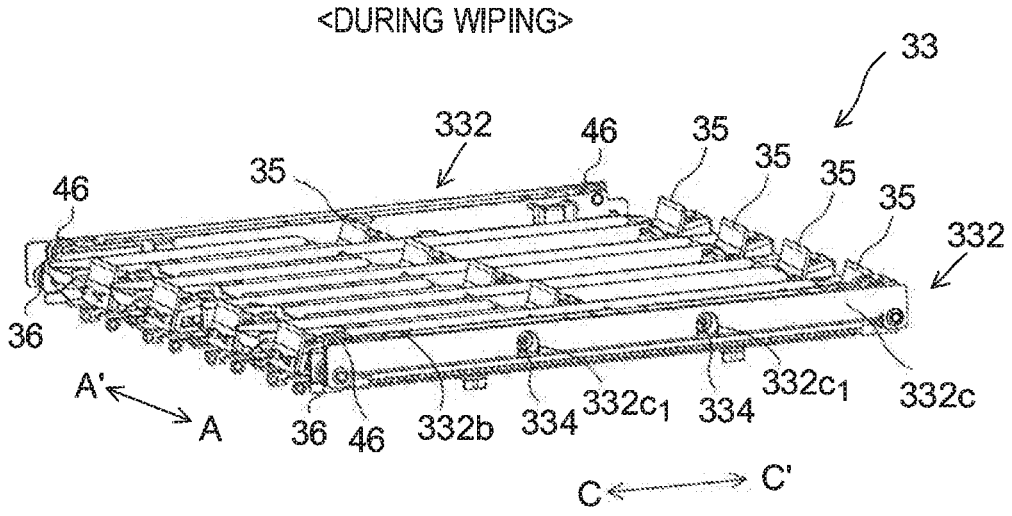
FIG. 27 is a perspective view of the wiper carriage during wiping.
Figure 28:
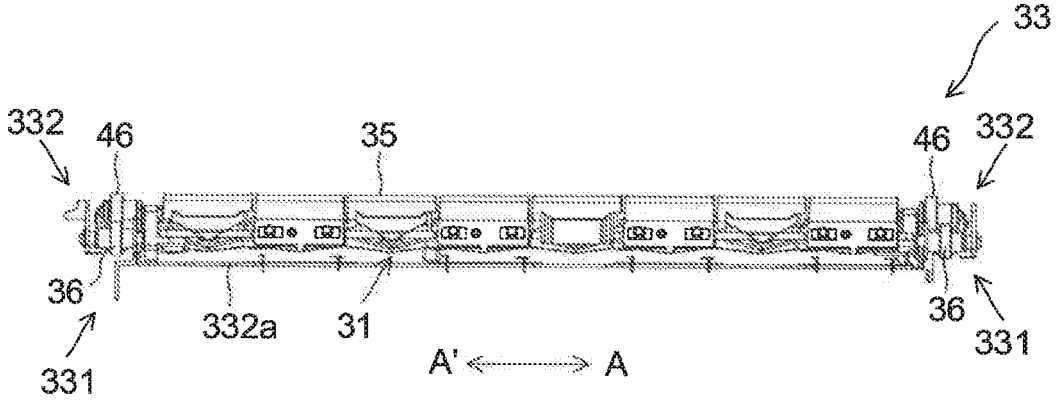
FIG. 28 is a front view of the wiper carriage during wiping.
Figure 30:
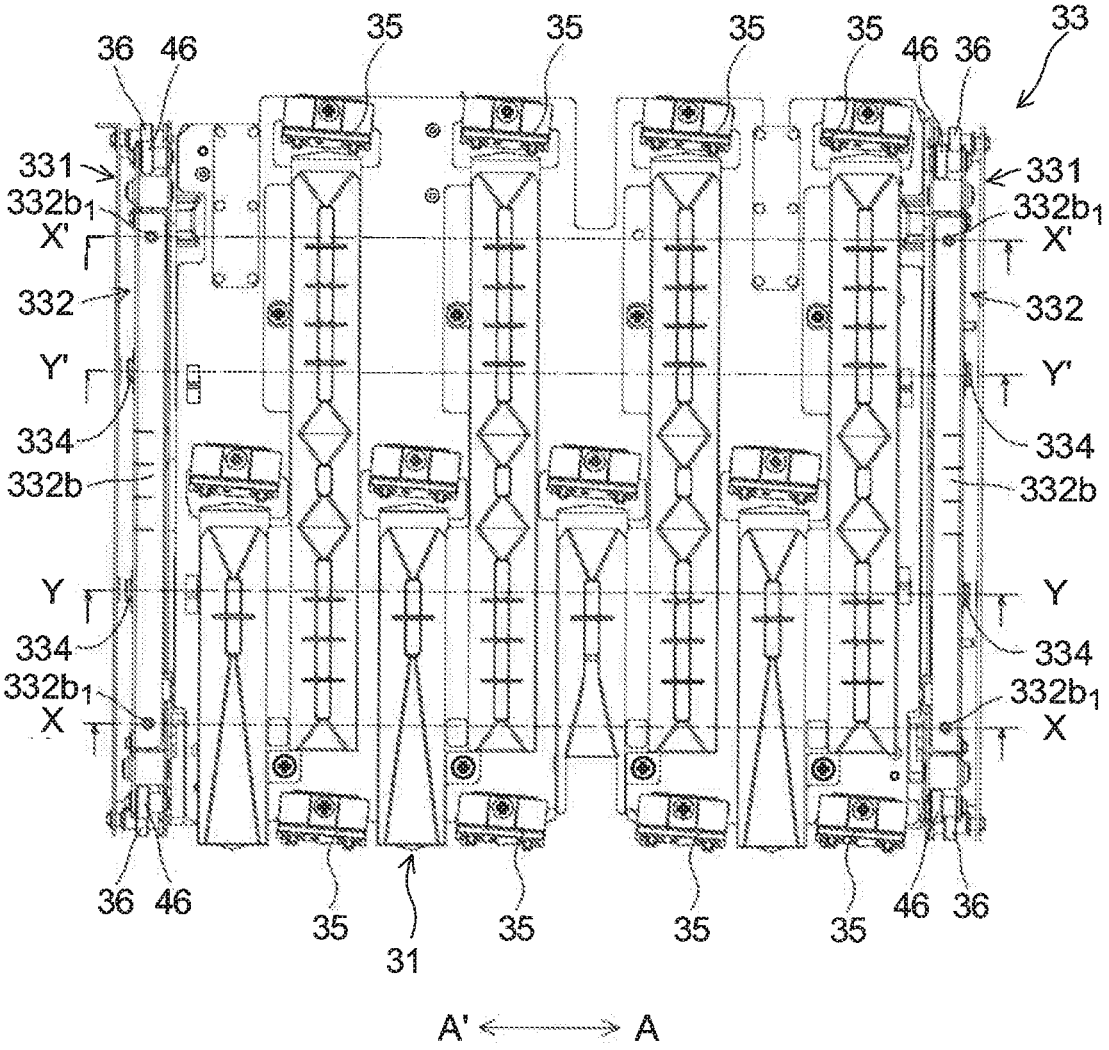
FIG. 30 is a plan view of the wiper carriage during wiping.
Figure 31:
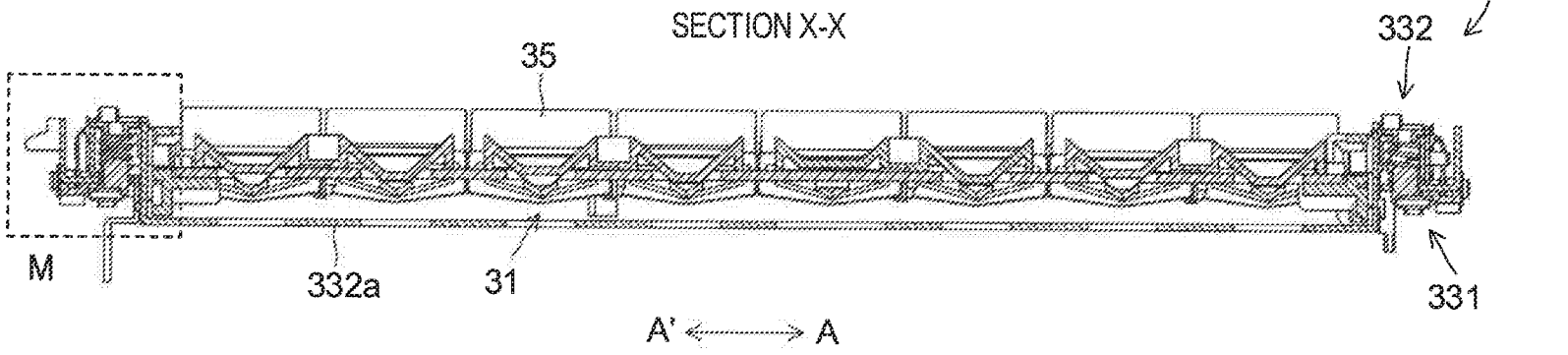
FIG. 31 is a sectional view across line X-X in FIG. 30.
Figure 32:
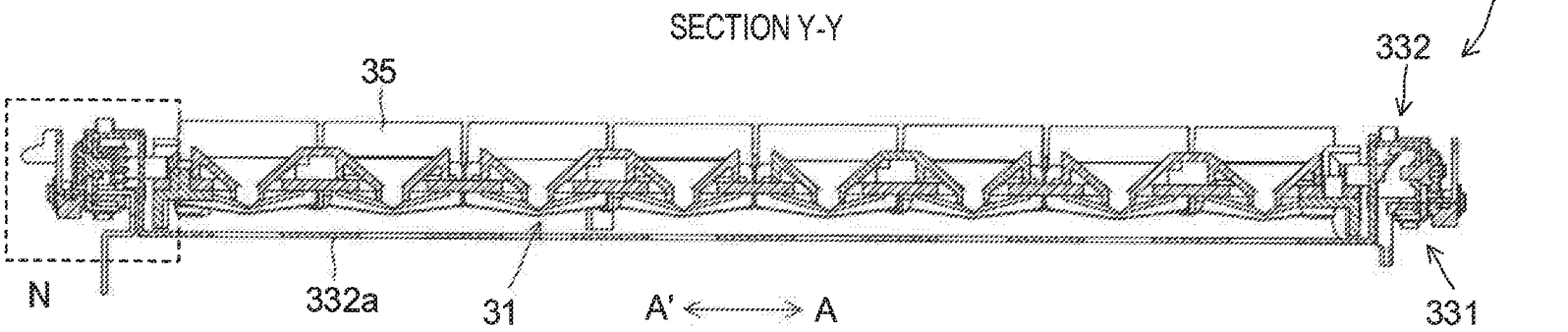
FIG. 32 is a sectional view across line Y-Y in FIG. 30.
Figure 33:
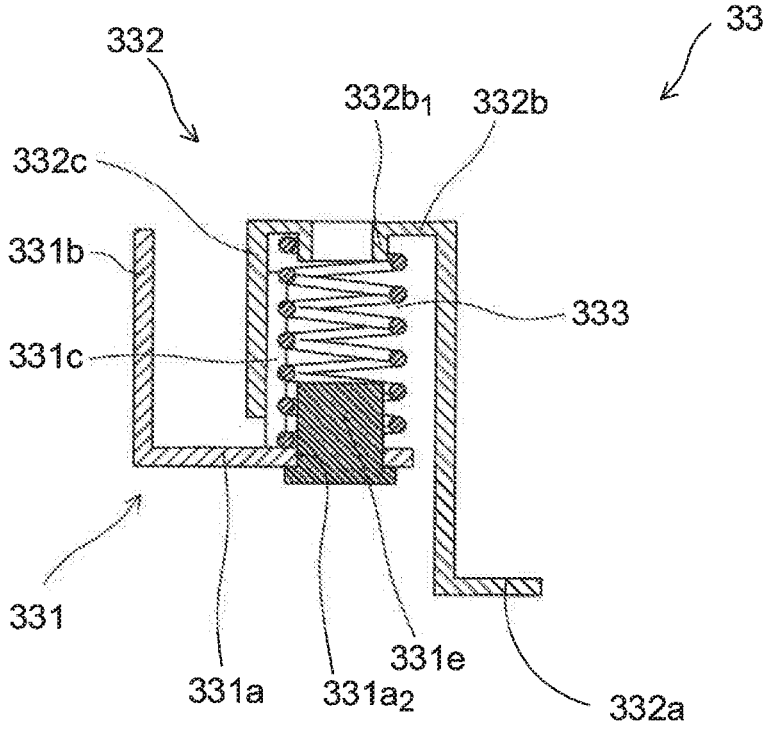
FIG. 33 is a sectional view showing part M in FIG. 31 in a simplified form on an enlarged scale.
Figure 34:
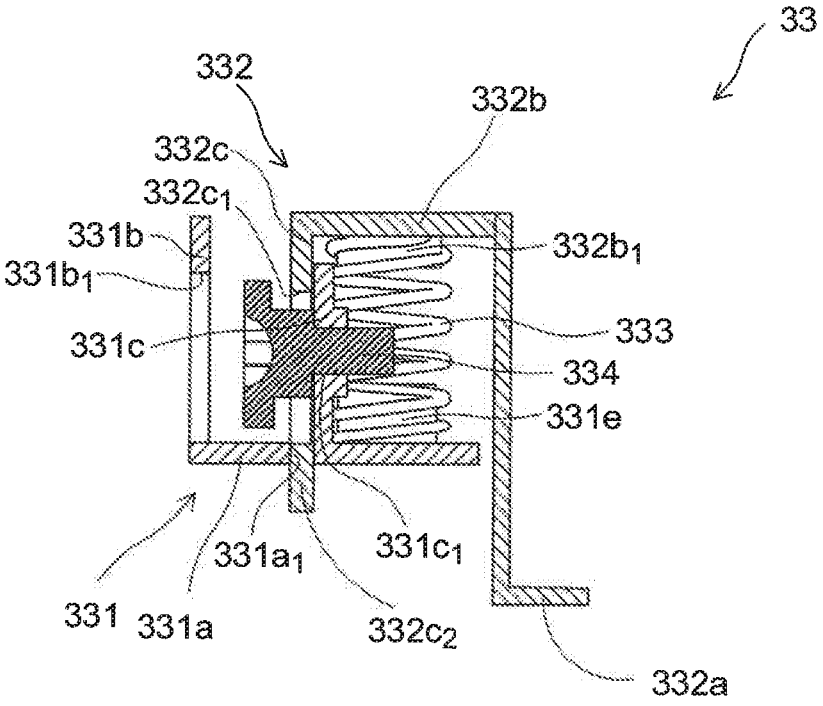
FIG. 34 is a sectional view showing part N in FIG. 32 in a simplified form on an enlarged scale.

On the other hand, FIGS. 27 and 28 are a perspective view and a front view, respectively of the wiper carriage 33 during wiping, and FIG. 29 is a perspective view showing a relative positional relationship between the positioning pins 334 and the movable portion 332 during wiping. FIG. 30 is a plan view of the wiper carriage 33 during wiping, FIG. 31 is a sectional view across line X-X in FIG. 30, and FIG. 32 is a sectional view across line Y-Y in FIG. 30. The sectional views in FIGS. 31 and 32 are generally the same as the sectional views across lines X'-X' and Y'-Y', respectively, in FIG. 30 except that the wiping blades 35 exhibit different appearances. FIG. 33 is a sectional view showing part M in FIG. 31 in a simplified form on an enlarged scale, and FIG. 34 is a sectional view showing part N in FIG. 32 in a simplified form on an enlarged scale.

During wiping, the maintenance unit 19 is pushed up, that is, toward the recording portion 9, by the unit ascent-descent mechanism 202. In this state, even if, due to dimensional errors in the components of the device and errors occurring during assembly, the maintenance unit 19 (e.g., the wiping blades 35) is pressed against the recording heads 17*a* to 17*c* in the recording portion 9 with an excessive pressing force stronger than a predetermined pressing force, the coil springs 333 receive, via the movable portion 332 supporting the wiping blades 35, the reaction force of the excessive pressing force and contract elastically (see FIGS. 33 and 34). Thus, the wiping of the ink ejection surfaces F is performed in a state where the excessive pressure on the ink ejection surfaces F from the wiping blades 35 is reduced. Here, the predetermined pressing force denotes the ideal design pressing force, and corresponds to the upper limit value of the pressing force with which the wiping blades 35 can wipe the ink ejection surfaces F while keeping the driving torque of the wiper drive motor 45 (see FIG. 11) within the tolerated range.

On completion of wiping, the maintenance unit 19 is lowered by the unit ascent-descent mechanism 202. As the maintenance unit 19 lowers, the wiping blades 35 moves away from the ink ejection surfaces F; thus the above-mentioned reaction force of the pressing force no longer acts on the coil springs 333. Accordingly, the coil springs 333 expand, and the positional relationship between the movable portion 332 and the stationary portions 331 returns to that shown in FIGS. 25 and 26.

As described above, in a maintenance device 200 according to the embodiment, even if the maintenance unit 19 is pressed against the plurality of recording heads 17*a* to 17*c* with an excessive pressing force by the unit ascent-descent mechanism 202, the coil springs 333 receive the reaction force of the excessive pressing force and contract elastically. Thus, the plurality of wiping blades 35 supported on the movable portion 332 can be pressed against the ink ejection surfaces F in a state where the excessive pressing force is recued (absorbed, canceled) by the coil springs 333. Thus, it is possible to adequately press the plurality of wiping blades 35 against the ink ejection surfaces F and to properly wipe the ink ejection surfaces F. Since the excessive pressing force is reduced, it is possible to drive the wiper drive motor 45 in the optimum torque range, and to reduce the driving load of the wiper drive motor 45. The reduced excessive pressing force helps prolong the lifetime (replacement cycle) of the plurality of wiping blades 35.

According to the embodiment, the plurality of wiping blades 35 are all together fixed to the blade unit 31, and the blade unit 31 is supported on the movable portion 332. Thus, all the wiping blades 35 can be supported stably on the movable portion 332 via the blade unit 31. It is thus possible to suppress uneven wiping of the ink ejection surfaces F among the plurality of wiping blades 35.

The coil springs 333 are located respectively between one and the other flat plate portions 332*b* of the movable portion 332 and one and the other flat plate portions 331*a* of the stationary portions 331. Owing to this positional relationship, when the maintenance unit 19 is pressed against the plurality of recording heads 17*a* to 17*c* with an excessive pressing force, the reaction force of the excessive pressing force can be received by the flat plate portions 332*b* of the movable portion 332 and transmitted reliably to the coil springs 333. It is thus possible to reliably obtain the above-mentioned effect of the embodiment resulting from the elastic compression of the coil springs 333.

The positioning pins 334 are inserted in the through holes 332$c_1$ in the movable portion 332, and are fixed to the inner walls 331*c* as the stationary-side wall portion of the stationary portion 331. Thus, owing to elastic deformation (expansion or contraction) of the coil springs 333, even if the movable portion 332 tends to move more than necessary in the ascent-descent direction relative to the stationary portions 331, the positioning pins 334 make contact with one-end or other-end portions, in the ascent-descent direction, of the through holes 332*c*, in the movable portion 332 and prevent further movement. Thus, it is possible to restrict more-than-necessary movement of the movable portion 332 in the ascent-descent direction.

As the elastic members that elastically support the movable portion 332 relative to the stationary portions 331, coil springs 333 that expand and contract in the ascent-descent direction of the maintenance unit 19 by the unit ascent-descent mechanism 202 are used. It is thus possible to easily obtain a structure that reduces the above-mentioned excessive pressing force by elastic expansion and contraction in the ascent-descent direction.

The elastic members are not limited to the coil springs 333 mentioned above. Also when, for example, leaf springs or pieces of elastically deformable rubber are used as the elastic members, it is possible to obtain the above-mentioned effect of the embodiment.

A printer 100 as an inkjet recording apparatus according to the embodiment includes a first belt conveying portion 5 that conveys a sheet P as a recording medium, a recording portion 9 in which recording heads 17*a* to 17*c* that eject ink onto the sheet P conveyed by the first belt conveying portion 5 are arranged, and a maintenance device 200 according to the embodiment that wipes the ink ejection surfaces F of the recording heads 17*a* to 17*c*. With this structure, in the inkjet recording apparatus, it is possible to obtain the above-mentioned effect of the embodiment, that is, for example, it is possible to adequately press the plurality of wiping blades 35 against the ink ejection surfaces F and to properly wipe the ink ejection surfaces F.

While the embodiment deals with an example where a maintenance device 200 is applied to a color inkjet recording apparatus (printer 100), it is also possible to apply a maintenance device 200 to a monochrome inkjet recording apparatus provided with a plurality of recording heads.

As discussed above, with a structure according to the embodiment, it is possible to move a maintenance unit from a retracted position (a second position) via a first position to a third position with a unit movement mechanism and a unit ascent-descent mechanism and to perform maintenance in which the ink ejection surfaces of a plurality of recording heads are wiped.

Even if, for example due to dimensional errors in the components of the device and errors occurring during assembly, the maintenance unit is pressed against the recording heads with an excessive pressing force by the unit ascent-descent mechanism, the elastic members on the wiper carriage receive the reaction force of the excessive pressing force and contract elastically. Thus, it is possible to reduce the excessive pressing force. It is thus possible to press the plurality of wiping blades supported on the movable portion via the blade unit against the ink ejection surfaces of the plurality of recording heads with a predetermined (adequate) pressing force and to properly wipe the ink ejection surfaces.

The plurality of wiping blades are fixed to the blade unit that is attached to the movable portion. Thus, the individual wiping blades can be supported more stably than in a conventional structure where a plurality of wiping blades are supported individually with springs. It is thus possible to suppress uneven wiping of the ink ejection surfaces among the plurality of wiping blades.

The present disclosure finds applications in inkjet recording apparatuses that record an image by ejecting ink onto a recording medium.

The description of an embodiment of the present disclosure given above is not meant to limit the scope of the present disclosure; what is disclosed herein can be implemented with any modifications made within the spirit of the present disclosure.

What is claimed is:

1. A recording head maintenance device comprising:

a maintenance unit having a plurality of wiping blades, the plurality of wiping blades wiping ink ejection surfaces of a plurality of recording heads, the plurality of recording heads ejecting ink onto a recording medium;

a maintenance carriage that supports the maintenance unit; and a unit movement mechanism that moves the maintenance carriage reciprocally between a first position where the maintenance carriage faces, across an interval, the ink ejection surfaces of the plurality of recording heads and a second position where the maintenance carriage is retracted from the first position in a horizontal direction, wherein the maintenance carriage has:

a unit ascent-descent mechanism that raises and lowers the maintenance unit between the first position and a third position where the maintenance unit is in contact with the plurality of recording heads, the maintenance unit has:

a blade unit to which the plurality of wiping blades are fixed;

a wiper carriage to which the blade unit is attached; and a support frame that supports the wiper carriage, the support frame has:

a wiper movement mechanism that moves the wiper carriage in a direction in which the plurality of wiping blades wipe the ink ejection surfaces of the plurality of recording heads, the wiper carriage has:

first and second stationary portions, each having a sliding roller, the sliding roller sliding on the support frame as the plurality of wiping blades are moved by the wiper movement mechanism;

first and second movable portions that supports the blade unit, each of the first and second movable portions having a positioning roller, the positioning roller restricting, as the maintenance unit is moved from the first position toward the third position, a position of the plurality of wiping blades in a receding direction thereof relative to the ink ejection surfaces of the plurality of recording heads by making contact with a head housing supporting the plurality of recording heads; and first and second elastic members that elastically support the first and second movable portions, respectively, relative to the first and second stationary portions, respectively, the first and second elastic members elastically contracting, when the maintenance unit is pressed against the plurality of recording heads by the unit ascent-descent mechanism with an excessive pressing force stronger than a predetermined pressing force, by receiving a reaction force of the excessive pressing force, the first and second stationary portions respectively have first and second stationary-side flat plate portions extending along a movement direction of the wiper carriage by the wiper movement mechanism, the movable portion has first and second movable-side flat plate portions extending in the movement direction of the wiper carriage, the wiper carriage further has first and second positioning pins, the first and second positioning pins restricting movement of the movable portion in the ascent-descent direction relative to the stationary portion, the movable portion further has first and second movable-side wall portions, the first and second movable-side wall portions extending upright from the first and second movable-side flat plate portions, respectively, and the first and second movable-side flat plate portions having respective first and second through holes through which respective ones of the positioning pins are inserted, each of the first and second through holes being elongate in the ascent-descent direction, the first and second stationary portions further have respective first and second stationary-side wall portions, the first and second stationary-side wall portions respectively extending upright from the first and second stationary-side flat plate portions, the first and second positioning pins respectively inserted through the first and second through holes being fixed to the respective first and second stationary-side wall portions, the wiper carriage has two of the stationary portions with two of the stationary-side flat plate portions on the two stationary portions respectively, the movable portion has a carriage body to which the blade unit is attached, and the first and second movable-side flat plate portions are provided in each of opposite side end parts of the carriage body, respectively, the first and second movable-side flat plate portions are located to face respectively the first and second stationary-side flat plate portions in an ascent-descent direction of the maintenance unit by the unit ascent-descent mechanism, and the first and second elastic members are located between the first movable-side flat plate portion and the first stationary-side flat plate portion and the second movable-side flat plate portion and the second stationary-side flat plate portion, respectively.

2. The recording head maintenance device according to claim 1, wherein each of the first and second elastic members is a coil spring that expands and contracts in the ascent-descent direction of the maintenance unit by the unit ascent-descent mechanism.

3. An inkjet recording apparatus comprising:

the recording head maintenance device according to claim 1;

a recording medium conveying portion that conveys a recording medium; and a recording portion in which a recording head that ejects ink onto the recording medium conveyed by the recording medium conveying portion is arranged, wherein the recording head maintenance device wipes an ink ejection surface of the recording head arranged in the recording portion.

* * * * *